US012753919B2

(12) United States Patent
Mamayenko et al.

(10) Patent No.: US 12,753,919 B2
(45) Date of Patent: Oct. 6, 2026

(54) STRUCTURAL CONFIGURATION AND METHOD FOR ENVIRONMENTALLY SAFE SOLID WASTE AND BIOMASS PROCESSING TO INCREASE THE EFFICIENCY OF POWER GENERATION AND PRODUCTION OF OTHER USEFUL PRODUCTS

(71) Applicants: METAPLASMA S.L., Gijon Asturias (ES); INT-ENERGIA KFT., Budapest (HU); MOLEKULA-SZEGED KFT., Algyö (HU)

(72) Inventors: Arian Mamayenko, Gijon Asturias (ES); Lázár Mordkovics Potasnyik, Budapest (HU)

(73) Assignees: METAPLASMA S.L., Gijon Asturias (ES); INT-ENERGIA KFT., Budapest (HU); MOLEKULA-SZEGED KFT., Algyö (HU)

( * ) Notice: Subject to any disclaimer, the term of this patent is extended or adjusted under 35 U.S.C. 154(b) by 693 days.

(21) Appl. No.: 18/032,071

(22) PCT Filed: May 11, 2021

(86) PCT No.: PCT/HU2021/000007
§ 371 (c)(1),
(2) Date: Apr. 14, 2023

(87) PCT Pub. No.: WO2022/084703
PCT Pub. Date: Apr. 28, 2022

(65) Prior Publication Data

US 2024/0003540 A1 Jan. 4, 2024

(30) Foreign Application Priority Data

Oct. 19, 2020 (HU) ..... P2000344

(51) Int. Cl.
*F23G 5/033* (2006.01)
*F23G 5/04* (2006.01)

(52) U.S. Cl.
CPC ..... *F23G 5/033* (2013.01); *F23G 5/04* (2013.01); *F23G 2204/201* (2013.01)

(58) Field of Classification Search
None
See application file for complete search history.

(56) References Cited

U.S. PATENT DOCUMENTS 8,419,902 B2 * 4/2013 Feerer ..... F23G 5/02 48/119
9,410,094 B2 * 8/2016 Pye ..... B09B 3/45
(Continued)

FOREIGN PATENT DOCUMENTS

| | | | |
|---|---|---|---|
| CA | 2767030 | A1 | 1/2010 |
| EP | 3420278 | A2 | 1/2019 |
| WO | 2017212301 | A2 | 12/2017 |

OTHER PUBLICATIONS

International Search Report for PCT/HU2021/000007 dated Aug. 25, 2021.

(Continued)

*Primary Examiner* — John J Figueroa
(74) *Attorney, Agent, or Firm* — Csaba Henter; Millen, White, Zelano & Branigan, P.C.

(57) ABSTRACT

Method and structural configuration for environmentally safe solid waste and biomass processing to increase the efficiency of power generation and production of other useful products. Solid waste and biomass are loaded, crushed, then subjected to vacuum and temperature drying and shredded which are accumulated, then supplied to a fast plasma gasification reactor for fast plasma gasification. The obtained steam-gas mixture is condensed, separating the water steam from the steam-gas mixture. The obtained gas (Continued)

mixture, in the form of pyrolysis gas, is accumulated in turn in two variable volume gasholders. The hydrogen obtained as a result of electrolysis, as well as the pyrolysis gas from the first and then from the second variable volume gasholders are fed in turn, to the first and then to second recirculation Sabatier reactors for conducting a recirculating autothermal Sabatier reaction. Produced methane is compressed and accumulated, and used for electric power and heat.

17 Claims, 6 Drawing Sheets

(56) References Cited

U.S. PATENT DOCUMENTS 11,613,704 B2 * 3/2023 Brandhorst, Jr. ..... C10K 1/08 44/605
2006/0144305 A1 * 7/2006 Vera ..... F23J 15/04 110/341
2008/0209807 A1 * 9/2008 Tsangaris ..... C10J 3/723 48/89
2010/0115961 A1 * 5/2010 Chapman ..... F23G 5/085 202/99
2010/0288618 A1 * 11/2010 Feerer ..... C10B 47/44 202/118
2010/0293853 A1 * 11/2010 Feerer ..... C10B 47/44 48/203
2011/0036014 A1 * 2/2011 Tsangaris ..... C10J 3/721 48/197 FM
2011/0250100 A1 10/2011 Juranitch et al.
2012/0070347 A1 3/2012 Bacon et al.
2013/0300121 A1 * 11/2013 Ali ..... F23J 15/02 110/221
2020/0156973 A1 * 5/2020 Conrado ..... F23G 5/027
2022/0044910 A1 * 2/2022 Danylenko ..... F23G 5/085

OTHER PUBLICATIONS

English Abstract for WO2017212301, Publication Date: Dec. 14, 2017.

* cited by examiner

STRUCTURAL CONFIGURATION AND METHOD FOR ENVIRONMENTALLY SAFE SOLID WASTE AND BIOMASS PROCESSING TO INCREASE THE EFFICIENCY OF POWER GENERATION AND PRODUCTION OF OTHER USEFUL PRODUCTS

The present invention relates to the method and structural configuration for environmentally safe solid waste and biomass processing to increase the efficiency of power generation and production of other useful products. In accordance with the method of the invention, this can be achieved by rapid plasma gasification of solid waste and biomass, and conversion of pyrolysis gas. Solid waste and biomass can be successfully used to generate electric power by using their energy potential and obtaining methane in the process of waste processing, while ensuring the complete utilization of carbon dioxide. The resulting electric power and useful products can be used for energetics and ecology use. In addition, materials obtained during waste processing, such as, for example, metals, basalt-like slag, purified water, potassium salts solution as potash fertilizers, as well as oxygen, can be used to produce other useful materials and marketable products. These other useful products can be successfully used in medicine, construction, agriculture and other industries.

There are known schemes of plasma installations implementing technologies where the pyrolysis gas generated as a result of thermal destruction of solid household and industrial waste is either burned with the subsequent use of high-temperature combustion products to produce steam fed to turbine generator sets to generate electric power, or pyrolysis gas, which after preliminary gas cleaning, is used as fuel for the operation of diesel or gas turbine plants that generate electric power. In addition, as a result of high-temperature destruction of solid household and industrial waste, an environmentally friendly glassy slag is formed, which can be used as a building material. There are also known technological processes and systems operating using plasma gasification and gas conversion of pyrolysis gas where, in order to improve the efficiency of processing solid household and industrial waste, various technical solutions are used, such as preliminary drying of feedstock or the introduction of additional units such as the Sabatier reactor.

For example, there is a known waste processing unit, presented in the description of patent RU2375636 (C1), in which, in the funnel 4 of the feeder 2, raw material in the form of solid hydrocarbon-containing waste is fed continuously. Under the action of the rotating screw 5, the raw material moves and compresses in the feeder 2, enters the conical channel 7, where it is additionally compressed and squeezed into the housing 1, here the required temperature is created using an electric arc (depending on the processing method, it can be in the range of 500° C. . . . 1700° C.), at which decomposition of raw materials occurs without air access. The resulting pyrolysis gas enters the jacket 9, gives off part of the heat to the raw material in the feeder, heating it, and is removed through the branch pipe 21 of the jacket 9 for further processing. The solid residue is removed from the reactor by a discharge system 19 designed specifically to the type and amount of this residue. The disadvantage of this known solution is that with increased humidity of the waste to be processed, the proposed drying system would not ensure its effective drying, which would lead to additional high energy costs during waste processing, namely, to an increase in the power consumption of the electric arc, and, accordingly, such recycling would not be effective.

A system for generating CH4 and CO from various wastes is known (patent CA2767030 (A1). A system for generating CH4 and CO from waste contains either one of the Westinghouse plasma reactors (plasma melter) or one of the Europlasma plasma reactors (plasma melter) or one of the InEnTec plasma reactors (plasma melter), two pressure swing absorbers (PSA), a water gas conversion reactor and one Sabatier reactor, as well as several types of power plants and installations supplying carbon dioxide.

In accordance with the invention, the system is provided with a plasma melter having a feedstock input for receiving a fuel, which may be a feed waste, and a syngas output for producing a syngas having an H2 component. Additionally, a Sabatier reactor is provided having a hydrogen input for receiving at least a portion of the H2 component produced by the plasma melter, and a methane output for producing CH4. In one embodiment of the invention, there is provided a power plant having a methane input and a carbon dioxide output. A methane delivery system delivers the CH4 to the methane input of the power plant. The power plant is in some embodiments a conventional power plant and in other embodiments an O2 injected power plant. In additional embodiments, a CO2 collector is provided associated with the carbon dioxide output of the power plant. The Sabatier reactor is equipped with a carbon dioxide input and is adapted to receive input of carbon dioxide CO2 from any combination of power plants, either from a conventional power plant or from an O2 injected power plant, or from an ammonia plant, or from an H2 plant, or from an ethylene oxide plant, or from a natural gas plant, or from an ethanol plant. The plasma melter is arranged to receive at its feedstock input any combination of hazardous waste; medical waste; radioactive waste; municipal waste; coal; and algae biomass. In one embodiment of the invention, the plasma melter is a selectable one of a Westinghouse plasma melter and a Europlasma plasma melter. There is, in some embodiments, provided a pressure swing absorber (PSA) having an input for receiving the syngas from the plasma melter, and an output for providing H2 to the Sabatier reactor. In embodiments where the plasma melter is a Westinghouse plasma melter, the pressure swing absorber has a carbon monoxide output for producing CO. A power plant is provided having a carbon monoxide input, and there is further provided a carbon monoxide delivery system for delivering the CO from the Westinghouse plasma melter to the carbon monoxide input of the power plant. In embodiments of the invention where the plasma melter is a Europlasma plasma melter, the pressure swing absorber has a carbon dioxide output for producing CO2. A water gas shift reactor is arranged intermediate of the Europlasma plasma melter and the pressure swing absorber for converting syngas available at a syngas output of the Europlasma plasma melter to CO2+H2 and thereby enhancing methane conversion in the Sabatier reactor. The disadvantage of this known solution is the need to separate the pyrolysis gas into its constituent components CO, CO2 and H2 which, accordingly, requires the installation of additional equipment that ensures the separation of the above-mentioned constituent components of the pyrolysis gas. With this method of gas conversion, no 100% CO2 utilization occurs in the Sabatier reactor (see FIG. 3). The use of additional equipment for gas separation leads to its redundancy and, accordingly, increased energy and financial costs, which makes the implementation of the proposed solution ineffective and economically unprofitable.

In the patent description EP3420278 (A2) (FIG. 1A), the plasma reactor (10) includes a reaction volume (5) delimited by walling (14), a gas outlet port (19) and a melt processing unit (13), while said gas outlet port (19) limits the reaction volume (5) from the top, and said melt treatment unit (13) limits the reaction volume (5) from the bottom, and wherein—when the plasma reactor (10) is in operation—the reaction volume (5) is connected to both the gas outlet port (19) and the melt treatment unit (13) to maintain a free flow of material there through, and wherein the reaction volume (5) includes agaseous material treatment region (5C), a gasification region (5B) and a melt treatment region (5 A), the gaseous material treatment region opens directly to the gas outlet port (19), the melt treatment region (5 A) at least partially forms part of the melt treatment unit (13) and the gasification region (5B) is located between the gaseous material treatment region (5C) and the melt treatment region (5 A); a waste material supply mechanism passing through the walling (14) and opening into the gasification region (5B) of the reaction volume (5); plasma torches arranged to generate thermal plasma in each of said regions (5 A, 5B, 5C) of the reaction volume (5) separately, wherein at least one plasma torch is provided for generating the thermal plasma in each region (5 A, 5B, 5C); sensors (11, 11') arranged in said regions (5 A, 5B, 5C) of the reaction volume (5), the sensors (11, 11') are configured to monitor physical and/or chemical conditions prevailing within said regions (5 A, 5B, 5C) and to measure physical/chemical parameters representative of said conditions at given instances when the plasma reactor (10) is in operation; a data collecting and control unit, wherein said sensors (11, 11') are in data communication connection with the data collecting and control unit for transferring measurement data obtained by measurements performed by the sensors, the measurement date being representative of the instantaneous physical and/or chemical conditions prevailing within said regions (5 A, 5B, 5C) when the plasma reactor (10) is in operation.

The gas treatment stage 120 is used for the adequate treatment (cooling, cleaning, etc.) of the gaseous material leaving the plasma reactor 10 (through the gas outlet port 19, see FIG. 1) before the gaseous material is processed further. Said gaseous material is substantially a hot mixture (at a temperature of at least about 3000° C.) of synthesis gas, metallic vapor and other contaminants. The gas treatment stage 120 basically comprises a secondary reaction volume 125, a quencher 130 and a scrubber unit 135.

The disadvantage of this known solution is that when the gas exits through the gas outlet port 19 from the plasma reactor 10, as indicated in the description of this known solution, the gaseous material is essentially a hot mixture (at a temperature of at least about 3000° C.) of syngas, metal vapors and a number of other pollutants, that is, when the gas leaves the plasma reactor 10, the capture of metal vapors and small fractions of particles of the processed waste occurs, which requires additional measures in the form of afterburning, quenching and expensive purification of pyrolysis gas, which is indicated in the description of this known solutions. This leads to rise in prices of the entire waste processing and, accordingly, to an increase in the prime cost of waste processing, which makes this known technical solution for waste processing unprofitable.

In view of the above, the aim of the invention is to eliminate the disadvantages of the known solutions and to create a structural configuration and method for environmentally safe processing of solid waste and biomass, using fast plasma gasification and gas conversion of pyrolysis gas to increase the efficiency of power generation, and production of other useful products, which can also increase the level of environmental safety of the processing and implement highly efficient, cost-effective production.

The embodiment is based on the recognition that the solid waste and biomass are loaded and crushed, then subjected to vacuum and temperature drying, as a result the dewatered and dried solid waste and biomass are shredded, the ferrous and non-ferrous metals are extracted from them and supplied as marketable products for external consumers, after that the shredded solid waste and biomass purified from metals are accumulated, then they are fed in a dosing method to the fast plasma gasification reactor, while ensuring the discharge of air excess formed during the dosing process into the atmosphere, in the fast plasma gasification reactor shredded solid waste and biomass purified from metals is subjected to fast plasma gasification, the steam-gas mixture obtained as a result of fast plasma gasification, is condensed, separating the water steam from the steam-gas mixture, and thus, the gas mixture freed from water steam, in the form of pyrolysis gas, is accumulated in turn in two variable volume gasholders; in the process of vacuum and temperature drying, the vacuum extraction of volatile compounds and water steam from solid waste and biomass are provided, the steam-air mixture and volatile compounds are compressed and accumulated, then the steam-air mixture and volatile compounds are subjected to plasma cleaning-disinfection and the superheated water steam is generated, which, as a plasma-forming gas, is supplied to the indirect arc plasma torches to the fast plasma gasification reactor for fast plasma gasification, where for indirect arc plasma torches that operate according to the scheme with "hot" cathode and anode (binary carbide compounds tungsten-tantalum or niobium-hafnium are used as materials for the manufacture of anodes and cathodes), and the steam-air mixture obtained in the process of plasma cleaning-disinfection, is condensed, separating water steam from the steam-air mixture extracted from solid waste and biomass, and the cleaned and disinfected air is released into the atmosphere; the hydrogen obtained as a result of electrolysis, as well as the pyrolysis gas from the first of two variable volume gasholders, is fed to the first of the two recirculation Sabatier reactors for the recirculating autothermal Sabatier reaction, the obtained steam-gas mixture as a result of the recirculating autothermal Sabatier reaction, containing mainly methane, is condensed, separating water steam from the steam-gas mixture, the resulting gas mixture is accumulated in the first of the two variable volume gasholders, therewith the cycle consisting of the supply of hydrogen obtained as a result of electrolysis and the supply of pyrolysis gas from the first of two variable volume gasholders to the first of the two recirculation Sabatier reactors for carrying out the recirculating autothermal Sabatier reaction, is repeated until there is a complete conversion of the gas mixture in the first of the two variable volume gasholders into methane, and the entire first gasholder is not filled with methane, therewith the content of methane in the steam-gas mixture, with each next cycle, will increase, and the total time for the conversion cycles of the gas mixture is limited and is determined by the ratio of the temperature parameters of the recirculation autothermal Sabatier reaction and the parameters of fast plasma gasification; after filling the first of the two variable volume gasholders with methane, the obtained methane from the first of the two varied volume gasholders is compressed and accumulated it in the first constant volume gasholder; at the same time with this, the hydrogen obtained as a result of electrolysis, as well as pyrolysis gas from the second of the two variable volume gasholders, are supplied on the second of the two recirculation Sabatier reactors for the recirculating autothermal Sabatier reaction, the obtained steam-gas mixture as a result of the recirculating autothermal Sabatier reaction, containing mainly methane, is condensed, separating water steam from the steam-gas mixture, the resulting gas mixture is accumulated in the second of two gasholders, therewith the cycle consisting of the supply of hydrogen obtained as a result of electrolysis and the supply of pyrolysis gas from the second of two variable volume gasholders to the second of the two recirculation Sabatier reactors for conducting a recirculating autothermal Sabatier reaction, which is repeated until there is a complete conversion of the gas mixture in the second of the two variable volume gasholders into methane and the entire second gasholder is filled with methane, while the methane content in the steam-gas mixture will increase with each next cycle, moreover, the total time of the conversion cycles for the gas mixture into methane is limited and is determined by the ratio of the temperature parameters of the recirculating autothermal Sabatier reaction and the parameters of fast plasma gasification, after filling with methane the second of the two variable volume gasholders, the methane obtained from the second of the two variable volume gasholders is compressed and accumulated in the first constant volume gasholder, at the same time with this, the gas conversion cycles for pyrolysis gas and gas mixture into methane using a recirculating autothermal Sabatier reaction repeat in the first recirculating autothermal Sabatier reactor and then repeat in the second recirculating autothermal Sabatier reactor, thus using recirculating Sabatier reaction the continuity of the technological process of the conversion of pyrolysis gas to methane is ensured; condensate obtained during condensation of water steam from a steam-gas mixture obtained during rapid plasma gasification, condensate obtained during condensation of water steam from a steam-air mixture extracted from solid waste and biomass, condensate obtained during condensation of water steam from a steam-gas mixture obtained during the recirculating autothermal Sabatier reaction in the first recirculation Sabatier reactor, condensate obtained during the condensation of water steam from the steam-gas mixture obtained during the recirculating autothermal Sabatier reaction in the second recirculation Sabatier reactor, as well as the condensate formed during the accumulation of the steam-air mixture and volatile compounds, is normalized by pH by means of dosing alkali, after there, membrane separation of the obtained normalized condensate into a solution of potassium salts and purified water is ensured, the resulting potassium salts solution is fed into a storage tank and accumulated, and then, as marketable product potassium fertilizer, is supplied to external consumers, the purified water is also accumulated, then part of the purified water is supplied for electrolysis, another part of the purified water is supplied to ensure plasma cleaning-disinfection and generation of superheated water steam, and the remaining third part, as a marketable product, is supplied to external consumers; vacuum and temperature drying are provided due to the extraction of heat obtained during condensate cooling during condensation of water steam from a steam-gas mixture during fast plasma gasification, from a steam-air mixture extracted from solid waste and biomass, from a steam-gas mixture obtained during the recirculating autothermal Sabatier reaction in the first recirculating Sabatier reactor and during the condensation of water steam from the steam-gas mixture obtained during the recirculating autothermal Sabatier reaction in the second recirculating Sabatier reactor, as well as due to the extraction of heat generated in the process of plasma cleaning-disinfection of the steam-air mixture and volatile compounds, while all these heat sources are combined into a single closed cooling circuit with heat recovery for vacuum and temperature drying; the oxygen obtained as a result of electrolysis is accumulated in the third variable volume gasholder, the accumulated oxygen is compressed and accumulated in the second constant volume gasholder, and then, as a marketable product, it is supplied to external consumers; the accumulated methane in the first constant volume gasholder is used as follows: part of the methane accumulated in the first constant volume gasholder is used as a marketable product and supplied to external consumers, and the other part of the methane accumulated in the first constant volume gasholder is used to generate electric power and heat; therewith, part of the generated electric power is supplied for own needs, and the other part of the generated electric power and heat is supplied to external consumers; carbon dioxide emitted from the exhaust gases generated during the production of electric power and heat is compressed, accumulated and directed to restrict air access when solid waste and biomass are fed in the dosing method to ensure fast plasma gasification; in the absence of the need to generate electric power and heat, electric power for own needs is produced from part of the accumulated methane in the first constant volume gasholder, and the other part of the accumulated methane in the first constant volume gasholder is used as a marketable product and supplied to external consumers; during fast plasma gasification, melting occurs and a basalt-like slag is formed, which are processed to produce granular slag, and the resulting granular slag, as a marketable product, is supplied to external consumers, thus the objectives of the structural configuration and method of the invention are achieved.

The nature of the invention is a structural configuration and a method for environmentally safe processing of waste and biomass using plasma gasification and gas conversion of pyrolysis gas to increase the efficiency of power production and production of other useful products.

The structural configuration includes a solid waste and biomass preparation unit, a fast plasma gasification unit, an electric power and heat generation unit, a carbon dioxide capture unit and a process control and monitoring unit, where the solid waste and biomass preparation unit contains an input for the solid waste and biomass treatment, a solid waste and biomass loading and crushing system, a solid waste and biomass shredding system, a metal separator system, a shredded solid waste and biomass storage tank, and a shredded solid waste and biomass feeding system. The input of the solid waste and biomass loading and crushing system is also the input for solid waste and biomass treatment of the solid waste and biomass preparation unit. The output of the solid waste and biomass shredding system is connected to the input of the metal separator system, and the first output of the metal separator system is connected to the input of the shredded solid waste and biomass storage tank. The second output of the metal separator system is the marketable ferrous metals output, as well as the first output of the solid waste and biomass preparation unit. The third output of the metal separator system is the marketable non-ferrous metals output, as well as the second output of the solid waste and biomass preparation unit. The first output of the solid waste and biomass preparation unit is also the marketable ferrous metals output in the configuration. The second output of the solid waste and biomass preparation unit is also the marketable non-ferrous metals output in the configuration. The output of the shredded solid waste and biomass storage tank is connected to the input of the shredded solid waste and biomass feeding system. The fast plasma gasification unit contains a slag collecting and granulating system. The output of the slag collecting and granulating system is the marketable granulated slag output, as well as the first output of the fast plasma gasification unit. The first output of the fast plasma gasification unit is also the marketable granulated slag output in the configuration. The electric power and heat generation unit contains at least one electric power and heat generation system, at least one exhaust gas cooling system, at least one exhaust stack, and a standby generator. The first output of at least one electric power and heat generation system is also the first output of the electric power and heat generation unit, the first output of which is also the first connection output for external electric power consumers in the configuration. The second output of at least one electric power and heat generation system is also the second output of the electric power and heat generation unit, the second output of which is also the second connection output for external heat consumers in the configuration. The third output of at least one electric power and heat generation system is connected to at least one exhaust gas cooling system, the output of at least one exhaust gas cooling system is also the third output of the electric power and heat generation unit for generating electric power and heat. The first input of the electric power and heat generation unit is also the first input of at least one electric power and heat generation system. The carbon dioxide capture unit contains a carbon dioxide capture system, a third compression system, a third constant volume gasholder and a carbon dioxide backup cylinder battery. The third output of the electric power and heat generation unit is connected to the input of the carbon dioxide capture unit, the input of which is also the input of the carbon dioxide capture system. The first output of the carbon dioxide capture system through the third compression system is connected to the input of the third constant volume gasholder, the output of which is combined with the output of the carbon dioxide backup cylinder battery and is also the first output of the carbon dioxide capture unit. The second output of the carbon dioxide capture system, which is also the second output of the carbon dioxide capture unit, to which the input of at least one exhaust stack of the electric power and heat generation unit is connected. The input of at least one exhaust stack is also the second input of the electric power and heat generation unit. The output of the exhaust stack is also the fourth output of the electric power and heat generation unit. The output of the exhaust stack is connected to the input of the process control and monitoring unit, which has two-way communications with other units in the configuration and consists of a process control and monitoring system and, at least, one environmental emission control system. The input to at least one environmental emission control system is also the input to the process control and monitoring unit. When there is no need to generate electric power and heat, the electric power and heat generation unit contains, instead of an electric power and heat generation system, an own-use electric power generation system. The input of the own-use electric power generation system is also the first input of the electric power and heat generation unit. The output of the own-use electric power generation system is connected to the input of at least one exhaust gas cooling system.

The structural configuration is characterized in that structural configuration also contains a heat recovery cooling unit, a gas conversion unit, a condensate processing unit and a hydrogen-oxygen unit, where the solid waste and biomass preparation unit additionally contains a vacuum and temperature drying system, a solid waste and biomass dosing system and a vacuum pump.

The output of the shredded solid waste and biomass feeding system is connected to the first input of the solid waste and biomass dosing system, the first output of which is also the fourth output of the solid waste and biomass preparation unit, which is connected to the first input of the fast plasma gasification unit. The fast plasma gasification unit also contains a compressor, a high-pressure receiver, an air-plasma steam generator, a fast plasma gasification reactor, a first condenser and a second condenser. The first input of the fast plasma gasification unit is also the second input of the fast plasma gasification reactor. The output of the solid waste and biomass loading and crushing system is connected to the first input of the vacuum and temperature drying system, the first output of which is connected to the input of the solid waste and biomass shredding system, and the second output of the vacuum and temperature drying system is connected to the input of the vacuum pump of the solid waste and biomass preparation unit. The second input of the vacuum and temperature drying system of the solid waste and biomass preparation unit is connected to the second output of the solid waste and biomass dosing system of the solid waste and biomass preparation unit, the third input of which is also the first input of the solid waste and biomass preparation unit. The second input of the solid waste and biomass dosing system of the solid waste and biomass preparation unit is also the second input of the solid waste and biomass preparation unit and is connected to the first output of the carbon dioxide capture unit. The third output of the solid waste and biomass dosing system of the solid waste and biomass preparation unit is also the sixth output of the solid waste and biomass preparation unit, the fifth output of which is also the third output of the vacuum and temperature drying system of the solid waste and biomass preparation unit. The sixth output of the solid waste and biomass preparation unit is also an air release output to the atmosphere of the configuration. The vacuum pump output is also the third output of the solid waste and biomass preparation unit, which is connected to the second input of the fast plasma gasification unit. The second input of the fast plasma gasification unit is also the input of the compressor, the output of which is connected to the input of the high-pressure receiver. The first output of the high-pressure receiver is connected to the first input of the air-plasma steam generator, the first output of which is connected to the first input of the fast plasma gasification reactor. The second output of the air-plasma steam generator is connected to the first input of the first condenser, the third output of which is also the seventh output of the fast plasma gasification unit. The seventh output of the fast plasma gasification unit is also the cleaned and disinfected air release output into the atmosphere of the configuration. The second output of the first condenser of the unit is connected to the third input of the air-plasma steam generator, the third output of which is also the sixth output of the fast plasma gasification unit. The first output of the fast plasma gasification reactor is connected to the first input of the second condenser, the third output of which is connected to the second input of the first condenser. The third output of the fast plasma gasification reactor is connected to the second input of the second condenser, the first input of which is also the second input of the fast plasma gasification unit. The input of the slag collecting and granulating system is connected to the second output of the fast plasma gasification reactor, the third input of which is also the fourth input of the fast plasma gasification unit. The second output of the high-pressure receiver is also the third output of the fast plasma gasification unit, the fourth output of which is also the first output of the first condenser. The second output of the second condenser is also the fifth output of the fast plasma gasification unit, the third input of which is also the second input of the air-plasma steam generator.

The first to eighth examples of the preferred implementation of the structural configuration of the invention are described in detail in the claims 2-9.

The subject-matter of the invention is also a method for environmentally safe waste and biomass processing using fast plasma gasification and pyrolysis gas conversion to increase the efficiency of the electric power generation and additional useful products generation, which consists in loading, crushing, and shredding solid waste and biomass, and its further separation from ferrous and non-ferrous metals to supply them as marketable products for external consumers, while accumulating shredded solid waste and biomass cleaned from metals. The accumulated, shredded and cleaned from metals solid waste and biomass is fed to the fast plasma gasification reactor, in the fast plasma gasification reactor, the shredded solid waste and biomass is subjected to fast plasma gasification, during which melting occurs and a basalt-like slag is formed, which is processed to produce granular slag, and the resulting granulated slag is supplied to the external consumers as a marketable product. Part of the methane accumulated in the first constant volume gasholder is used for the electric power and heat generation, while part of the generated electric power is supplied for own needs, and the other part of the generated electric power and heat is supplied to external consumers. Carbon dioxide captured from exhaust gases formed during the electric power and heat generation is compressed and accumulated. In the absence of the need to generate electric power and heat, electric power for own needs is produced from a part of the methane accumulated in the first constant volume gasholder.

The method of invention is characterized in that solid waste and biomass are subjected to vacuum and temperature drying. In the process of vacuum and temperature drying, the volatile compounds and water steam from solid waste and biomass are vacuum-extracted, the steam-air mixture and volatile compounds are compressed and accumulated, then the accumulated steam-air mixture and volatile compounds are subjected to plasma cleaning-disinfection and superheated steam is generated, which, as the plasma-forming gas, is fed to the indirect arc plasma torches into the fast plasma gasification reactor for fast plasma gasification, and the steam-air mixture obtained in the process of plasma cleaning and disinfection is condensed, separating water steam from the steam-air mixture extracted from solid waste and biomass, and cleaned and decontaminated air is released into the atmosphere.

The first to eighth preferred embodiments of the method of the invention are described in detail in the claims 10-17.

BRIEF DESCRIPTION OF THE DRAWINGS

The implementation of the invention is shown in more detail in the drawings, namely.

Figure 1:
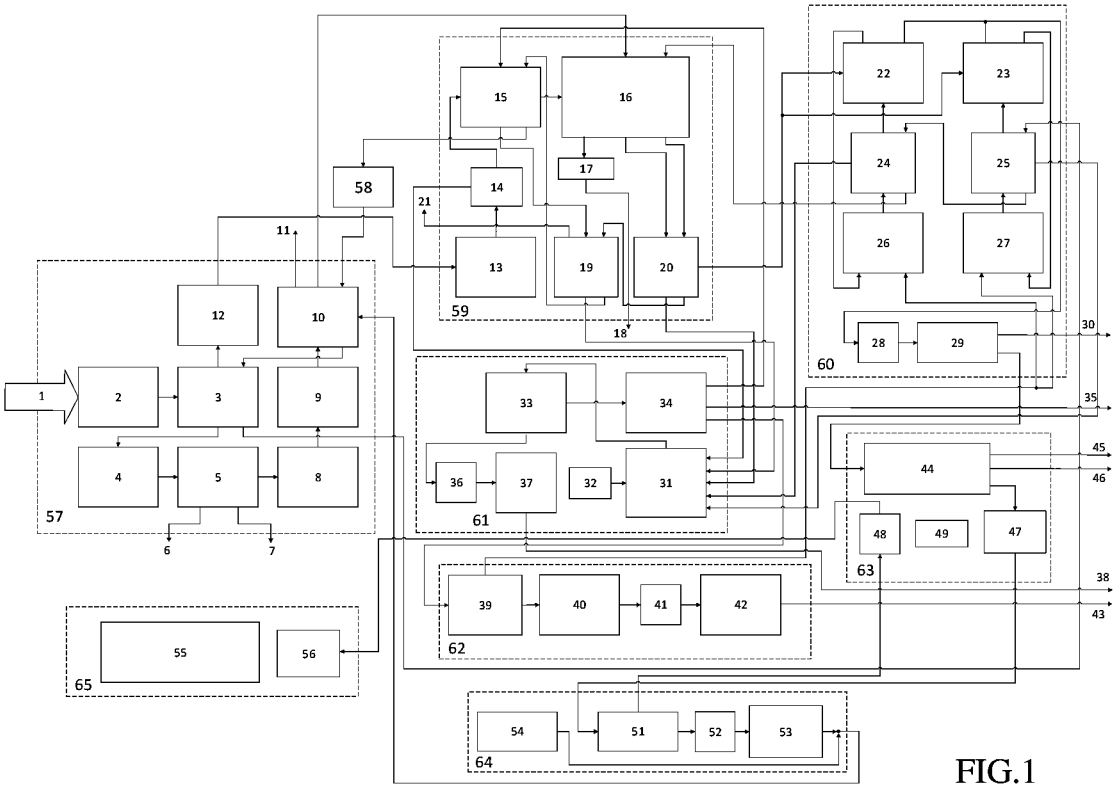
FIG. 1 shows a structural configuration of the subject-matter of invention.
Figure 2:
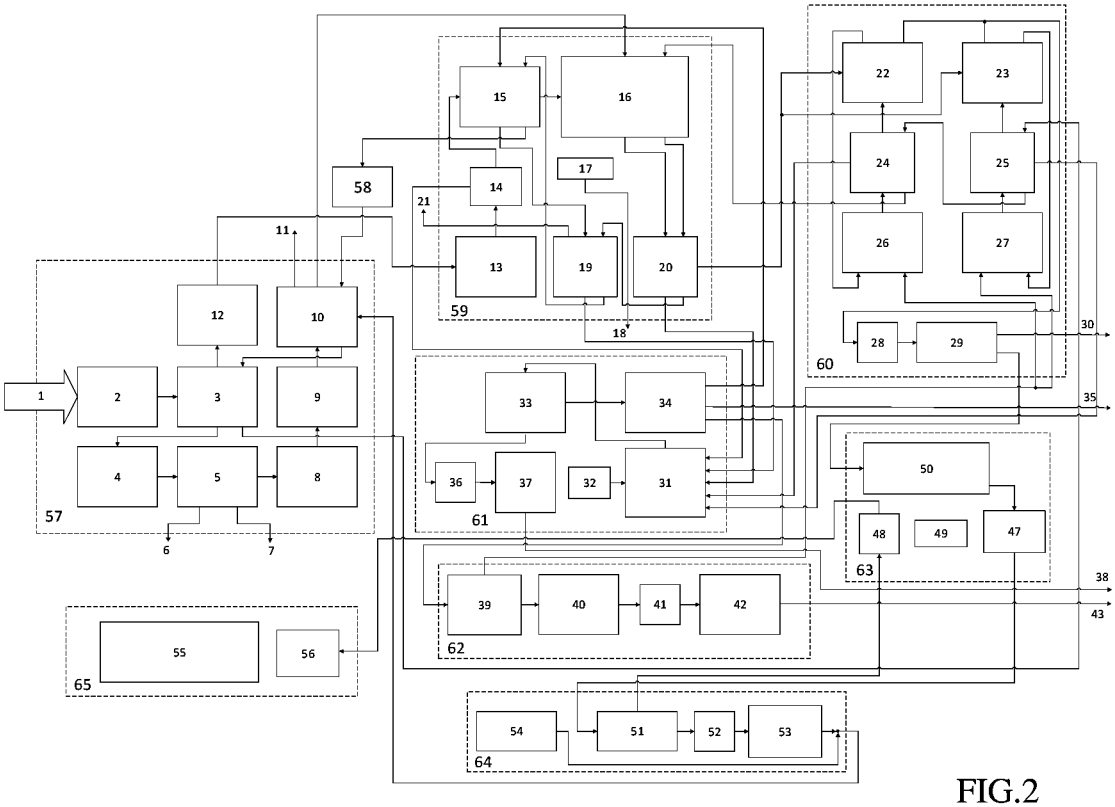
FIG. 2 shows another preferred embodiment of the structural configuration of the invention in the absence of the need for electric power and heat generation.

As can be seen in FIGS. 1 and 2, the invention has nine main units, namely: a solid waste and biomass preparation unit 57, a heat recovery cooling unit 58, a fast plasma gasification unit 59, a gas conversion unit 60, a condensate processing unit 61, a hydrogen-oxygen unit 62, an electric power generation unit 63, a carbon dioxide capture unit 64 and a process control and monitoring unit 65 (The process control and monitoring unit 65 has two-way communications with other units in the configuration, however, these communications are not shown in the drawing for convenience of illustration and clarity).

Figure 3:
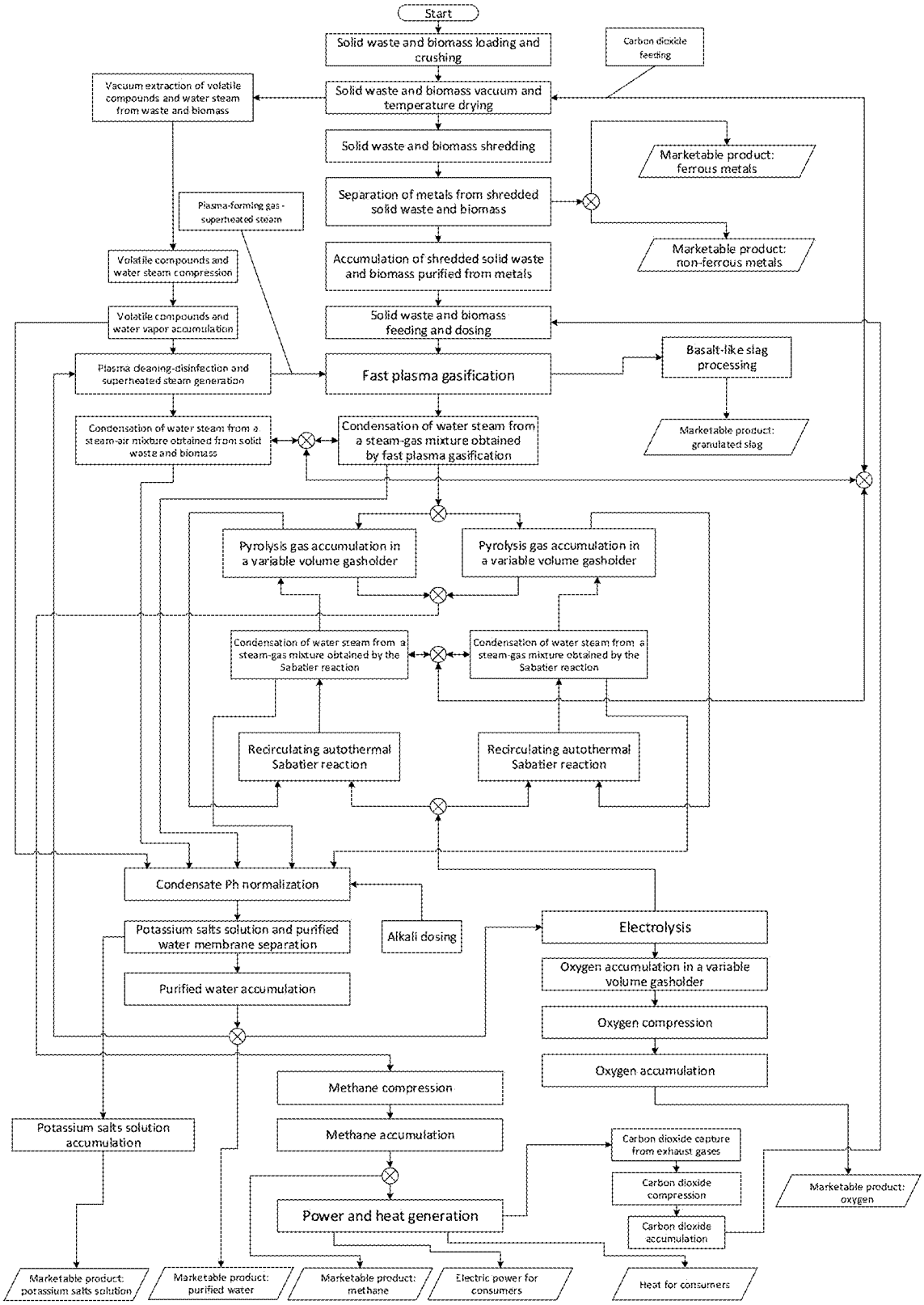
FIG. 3 shows the process flowchart of the embodiment of the environmentally safe method of the invention.

FIG. 3 shows a process flowchart of the embodiment of an environmentally safe method of the invention, which is characterized in the following stages of operation:

- incoming solid waste and biomass to be processed are loaded, crushed,
- crushed solid waste and biomass are subjected to vacuum and temperature drying,
- dehydrated and dried solid waste and biomass are shredded,
- ferrous and non-ferrous metals are extracted from shredded solid waste and biomass and supplied as marketable products for external consumers,
- shredded solid waste and biomass cleaned from metals are accumulated,
- the accumulated shredded solid waste and biomass cleaned from metals are fed in a dosing method to the fast plasma gasification reactor 16, while ensuring the release of excess air formed during the dosing process into the atmosphere,
- in the fast plasma gasification reactor 16 the shredded solid waste and biomass are subjected to fast plasma gasification,
- the steam-gas mixture obtained as a result of fast plasma gasification, is condensed, separating the water steam from the steam-gas mixture,
- the gas mixture freed from water steam is accumulated in the form of pyrolysis gas in two variable volume gasholders 22 and 23 in turn,
- in the process of vacuum and temperature drying, volatile compounds and water steam are provided vacuum extraction from solid waste and biomass,
- the steam-air mixture and volatile compounds are compressed and accumulated,
- the accumulated steam-air mixture and volatile compounds are subjected to plasma cleaning-disinfection and superheated steam is generated, which, as a plasma-forming gas, is fed to the indirect arc plasma torches into the fast plasma gasification reactor 16 for fast plasma gasification, all indirect arc plasma torches operate according to the scheme with "hot" cathode and anode manufactured from binary carbide compounds tungsten-tantalum or niobium-hafnium, the steam-air mixture obtained in the process of plasma cleaning-disinfection is condensed, separating the water steam from the steam-air mixture extracted from solid waste and biomass, and the cleaned and disinfected air is released into the atmosphere;

the hydrogen obtained as a result of electrolysis, as well as the pyrolysis gas from the first of two variable volume gasholders 22, are fed to the first of two recirculation Sabatier reactors 26 to carrying out a recirculating autothermal Sabatier reaction, the steam-gas mixture obtained as a result of the recirculating autothermal Sabatier reaction, containing mainly methane, is condensed, separating the water steam from the steam-gas mixture, the obtained gas mixture is accumulated in the first of the two variable volume gasholders 22, while the cycle consisting of feeding hydrogen obtained as a result of electrolysis and of feeding pyrolysis gas from the first of the two variable volume gasholders 22 to the first of the two recirculation Sabatier reactors 26 to carry out the recirculating autothermal Sabatier reaction, is repeated until there is a complete conversion of the gas mixture located in the first of the two variable volume gasholders 22 into methane and the entire first gasholder 22 will not be filled with methane, while the methane content in the steam-gas mixture will increase with each successive cycle, and the total time of the gas mixture conversion cycles is limited and is determined by the ratio of the temperature parameters of the recirculating autothermal Sabatier reaction and the parameters of fast plasma gasification;

after filling the first of the two variable volume gasholders 22 with methane, the methane obtained from the first of the two variable volume gasholders is compressed and accumulated in the constant volume gasholder 29, at the same time, hydrogen obtained as a result of electrolysis, as well as pyrolysis gas from the second of the two variable volume gasholders 23, are fed to the second of the two recirculation Sabatier reactors 27 to carry out a recirculating autothermal Sabatier reaction, the steam-gas mixture obtained as a result of the recirculating autothermal Sabatier reaction, containing mainly methane, is condensed, separating the water steam from the steam-gas mixture, the obtained gas mixture is accumulated in the second of the two variable volume gasholders 23, wherein the cycle consisting of feeding hydrogen obtained as a result of electrolysis and of feeding pyrolysis gas from the second of two variable volume gasholders 23 to the second of the two recirculation Sabatier reactors 27 to carry out the recirculating autothermal Sabatier reaction, is repeated until there is a complete conversion of the gas mixture located in the second of the two variable volume gasholders 23 into methane and the entire second gasholder 23 will not be filled with methane, wherein the methane content in the steam-gas mixture will increase with each successive cycle, and the total time of the gas mixture conversion cycles is limited and is determined by the ratio of the temperature parameters of the recirculating autothermal Sabatier reaction and the parameters of fast plasma gasification, after filling the second of two variable volume gasholders 22 with methane, the methane obtained from the second of the two variable volume gasholders is compressed and accumulated in the constant volume gasholder 29, at the same time, the cycles of the pyrolysis gas and the gas mixture conversion into methane using the recirculating autothermal Sabatier reaction are repeated in the first recirculation Sabatier reactor 26 and then repeated in the second recirculation Sabatier reactor 27, thus, using the recirculating autothermal Sabatier reaction, the continuity of the technological process of converting pyrolysis gas to methane is ensured;

condensate obtained during condensation of water steam from a steam-gas mixture obtained during fast plasma gasification, condensate obtained during condensation of water steam from a steam-air mixture extracted from solid waste and biomass, condensate obtained during condensation of water steam from the steam-gas mixture obtained during the recirculating autothermal Sabatier reaction in the first recirculation Sabatier reactor 26, condensate obtained during the condensation of water steam from the steam-gas mixture obtained during the recirculating autothermal Sabatier reaction in the second recirculation Sabatier reactor 27, as well as the condensate formed during the accumulation of the steam-air mixture and volatile compounds, are pH-normalized using alkali dosing, membrane separation of the obtained normalized condensate into a potassium salts solution and cleaned water are ensured, the obtained potassium salts solution is fed into a storage tank and accumulated, and as potassium fertilizers—marketable products are supplied to external consumers, the cleaned water is accumulated, then part of the cleaned water is supplied for electrolysis, the other part of the cleaned water is supplied to ensure plasma cleaning-disinfection and generation of superheated steam, and the remaining third part, as a marketable product, is supplied to external consumers, vacuum and temperature drying is provided due to the extraction of heat obtained during condensate cooling during condensation of water steam from the steam-gas mixture obtained during fast plasma gasification, from the steam-air mixture extracted from solid waste and biomass, from the steam-gas mixture obtained during the recirculating autothermal Sabatier reaction in the first recirculation Sabatier reactor 26 and during the recirculating autothermal Sabatier reaction in the second recirculation Sabatier reactor 27, as well as due to the extraction of heat generated in the process of plasma cleaning-disinfection of the steam-air mixture and volatile compounds, wherein all these heat sources are combined into a single closed cooling loop with heat recovery for vacuum and temperature drying, the oxygen obtained as a result of electrolysis is accumulated in the third variable volume gasholder 40, the accumulated oxygen in the third variable volume gasholder 40 is compressed and accumulated in the second constant volume gasholder 42, and then, as a marketable product, is supplied to external consumers, the accumulated methane in the first constant volume gasholder 29 is used as follows: part of the methane accumulated in the first constant volume gasholder 29 is used as a marketable product and is supplied to external consumers, and the other part of the methane accumulated in the first constant volume gasholder 29 is used for electric power and heat generation, wherein part of the generated electric power is supplied for own needs, and the other part of the generated electric power and heat is supplied for external consumers, carbon dioxide captured from the exhaust gases formed during the electric power and heat generation is compressed, accumulated and directed to restrict air access when solid waste and biomass are fed in the dosing method into the fast plasma gasification reactor 16 to ensure fast plasma gasification, during fast plasma gasification, melting occurs, and a basalt-like slag is formed, which is processed to produce granular slag, the obtained granulated slag, as a marketable product, is supplied to external consumers.

Figure 4:
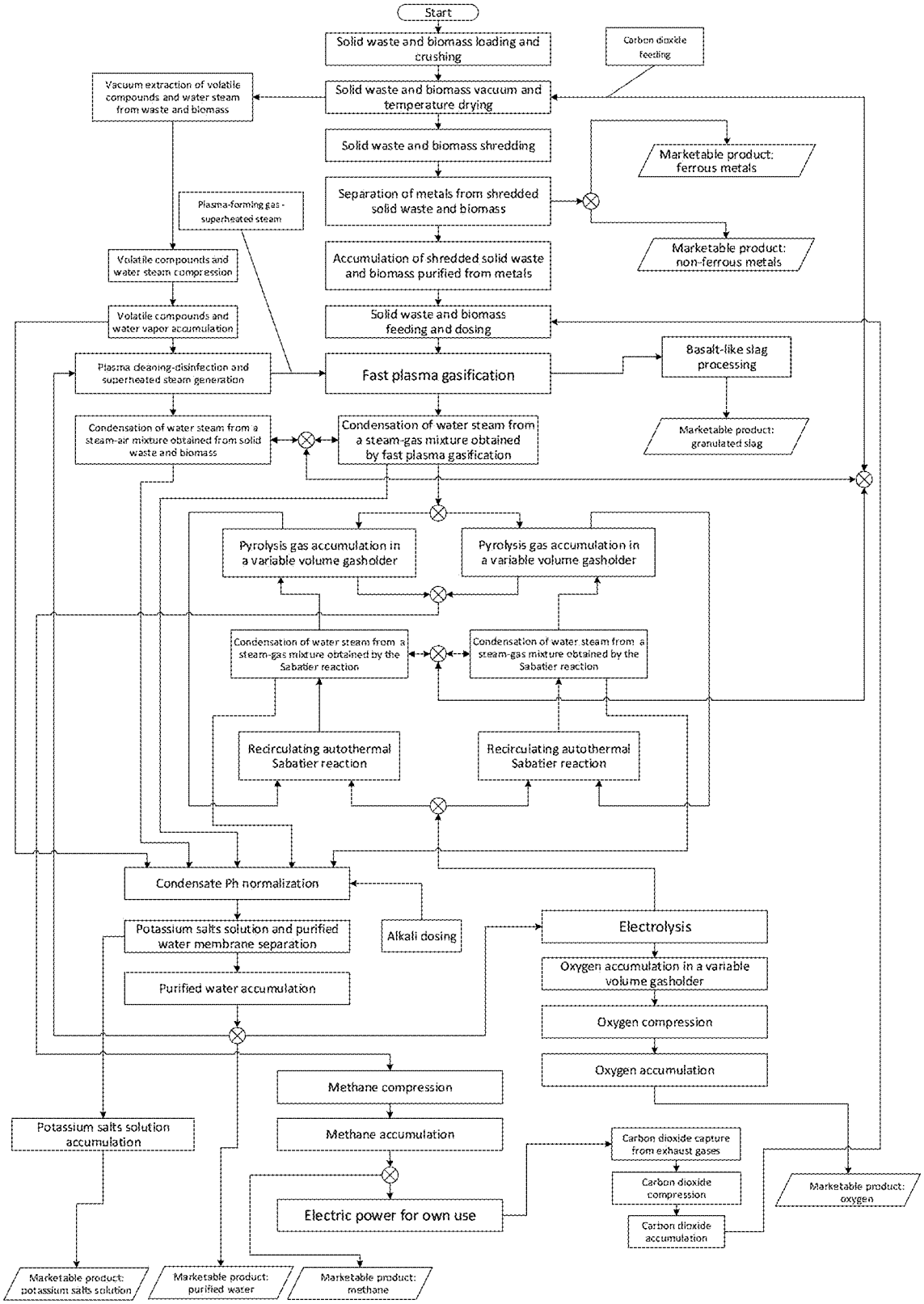
FIG. 4 shows the process flowchart of another embodiment of the environmentally safe method of the invention in the absence of the need for electric power and heat generation.

FIG. 4 shows a process flowchart of another embodiment of the environmentally safe method of the invention, which is different from the process flowchart of FIG. 3, which consists in the fact that in the absence of the need to generate electric power and heat, electric power for own needs is produced from part of the accumulated methane in the first constant volume gasholder 29, and the other part of the methane accumulated in the first constant volume gasholder 29 is used as a marketable product and supplied to external consumers.

The structural configuration of the invention works as follows:

The structural configuration of the invention is provided with three main interconnected technological processes operates as follows:

technological process of solid waste and biomass preparation and related technological processes, technological process of fast plasma gasification and related technological processes, technological processes of condensation, water treatment and gas conversion and related technological processes.

Figure 5:
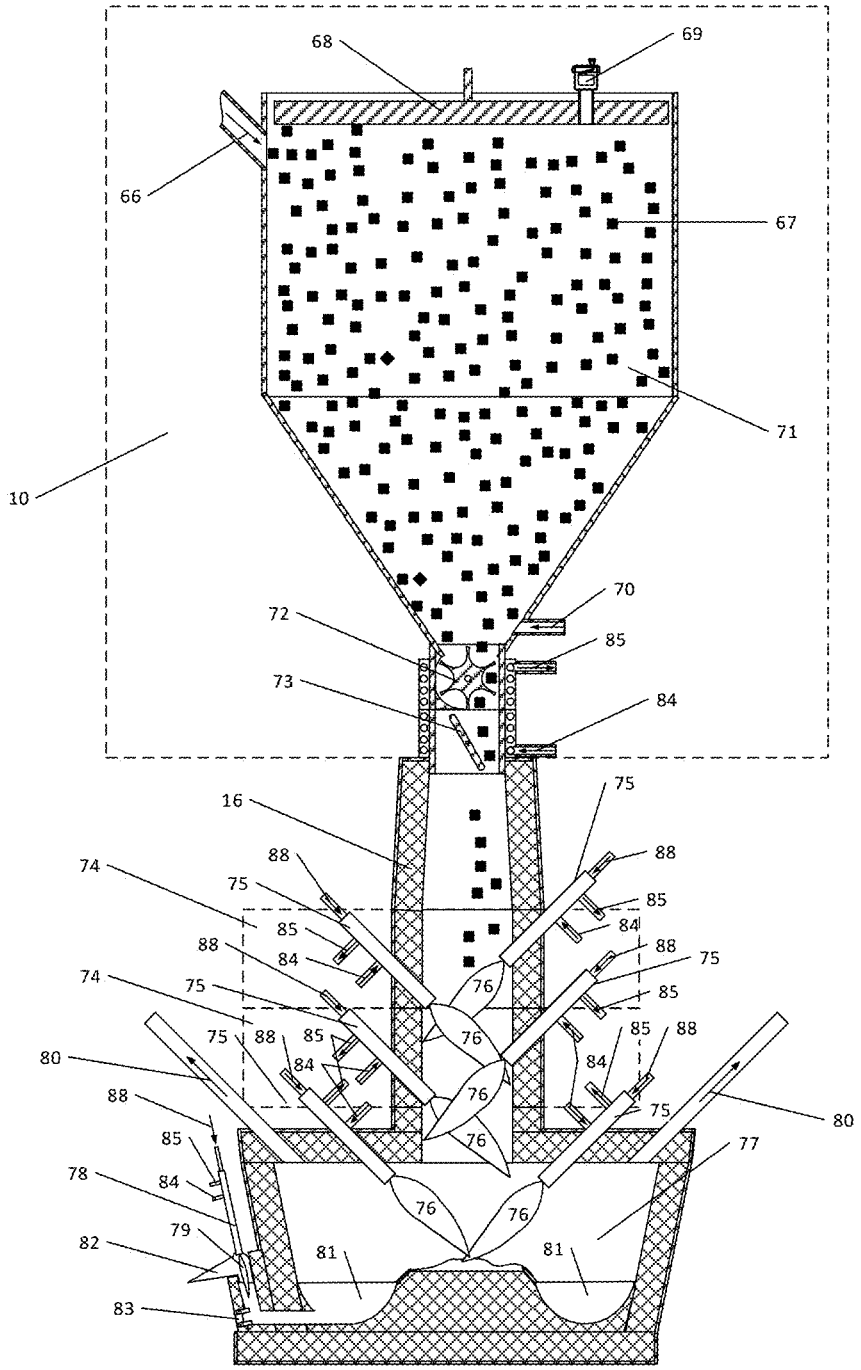
FIG. 5 shows one of the examples of the embodiment of the solid waste and biomass dosing system for the solid waste and biomass preparation unit and one of the examples of the embodiment of the fast plasma gasification reactor of the fast plasma gasification unit in the implementation of plasma gasification based on the indirect arc plasma torches.
Figure 6:
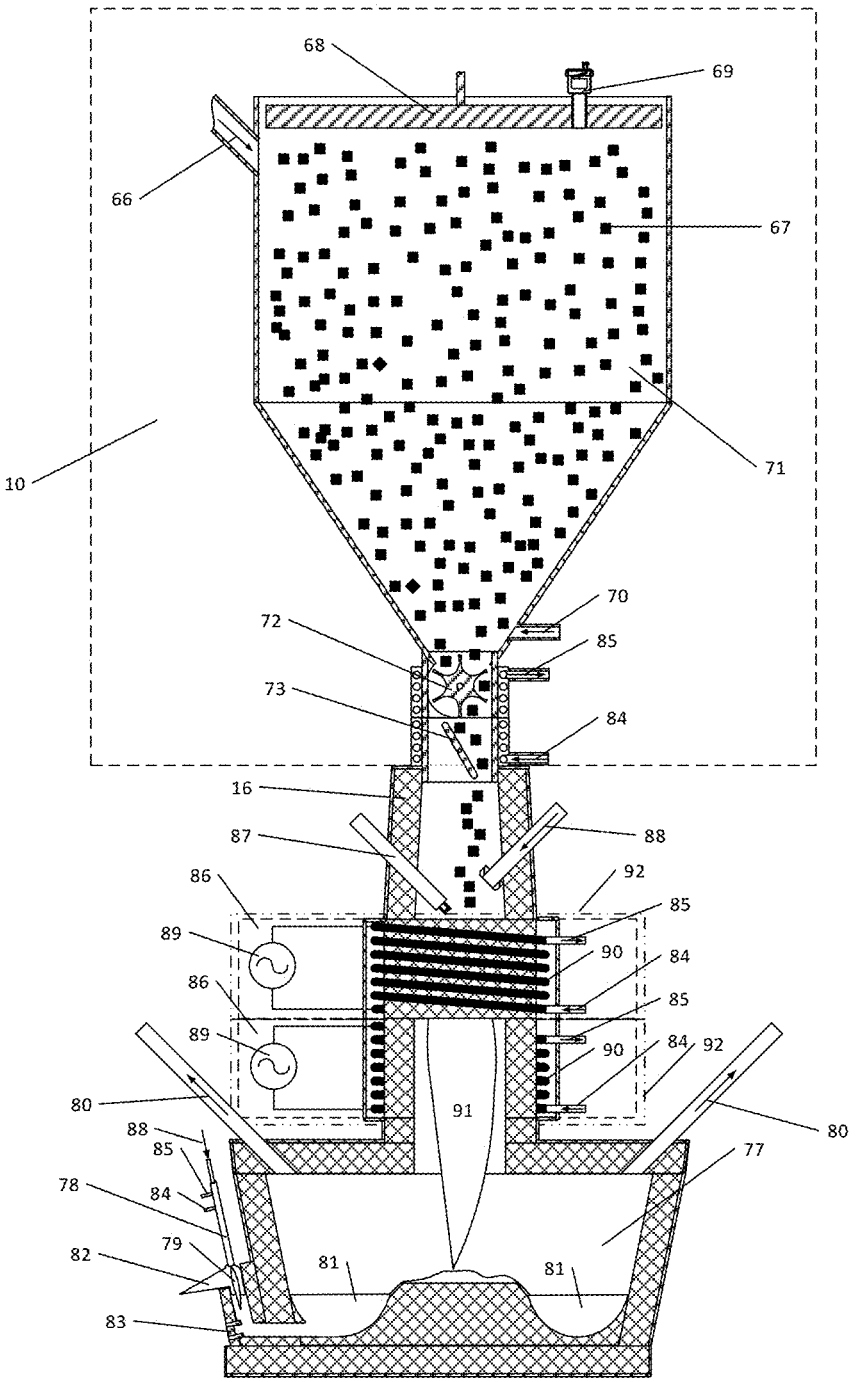
FIG. 6 shows one of the examples of the embodiment of a solid waste and biomass dosing system for a solid waste and biomass preparation unit and another embodiment of a fast plasma gasification reactor of a fast plasma gasification unit in the implementation of plasma gasification based on the inductively coupled plasma.
Figure 7:
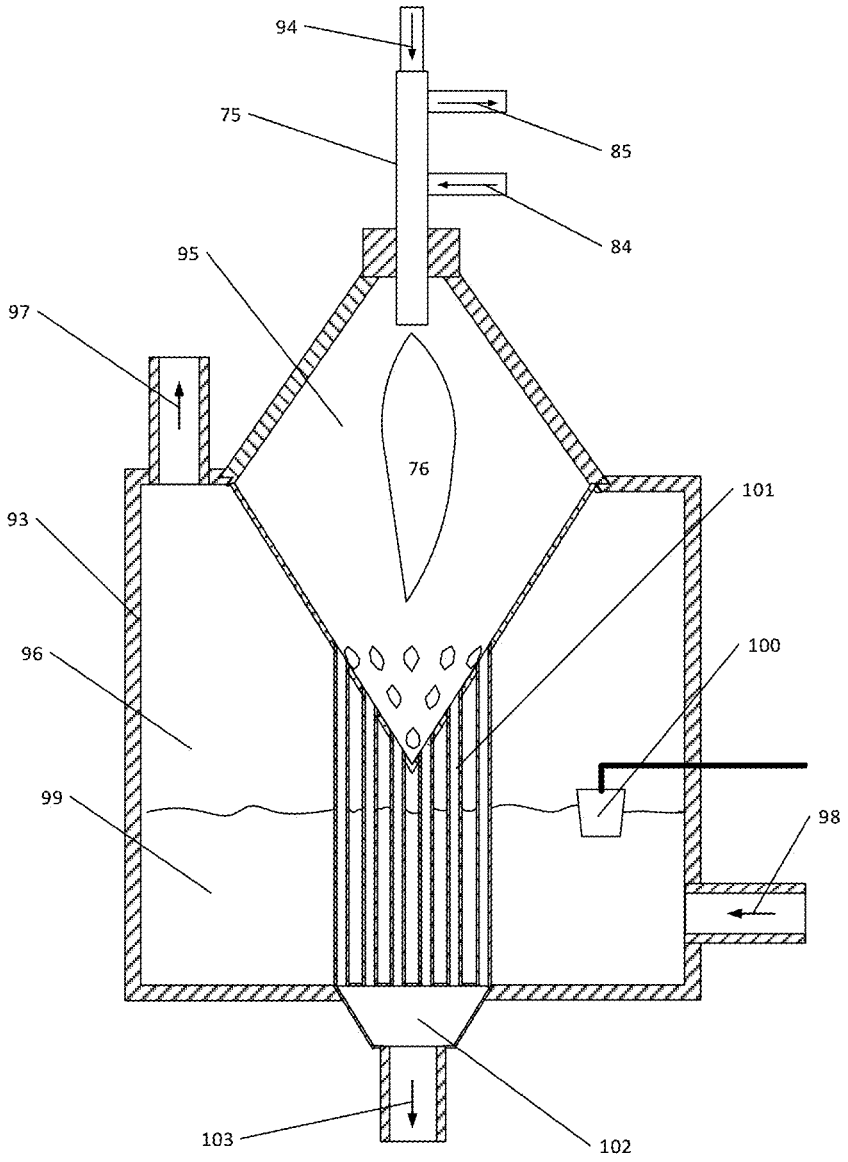
FIG. 7 shows one of the examples of the embodiment of the air-plasma steam generator system of the fast plasma gasification unit.

In accordance with one of the embodiments of the structural configuration of the invention, the technological process for the preparation of solid waste and biomass and related technological processes, as well as equipment implementing the operation of these technological processes, operate as follows. As shown in FIG. 1, solid waste and biomass entering the receiving area—at the solid waste and biomass input 1—are fed to the solid waste and biomass loading and crushing system 2, where they are crushed to a fraction of 10-30 mm required for the next technological stage—vacuum drying. The vacuum and temperature drying system 3 is a horizontal cylindrical vacuum chamber with hemispherical lids opening on both sides and equipped with an inside conveyor belt for loading solid waste and biomass. The system housing is made double-walled with corresponding stiffeners and constitutes a cooling jacket of technological water coming from the heat recovery cooling unit 58—a combined cooling system for all systems of the structural configuration of the invention and simultaneous heating of solid waste and biomass in the process of vacuum and temperature drying. Thus, heat recovery is performed in the heat recovery-cooling unit 58 and the total energy costs for the preparation of solid waste and biomass are reduced. The vacuum pump 12 provides the creation of a vacuum and removal of moisture, odors and volatile compounds from solid waste and biomass. Further, the air obtained from the vacuum pump 12, with a high content of water steam and volatile compounds, is supplied to the compressor 13, compressed and supplied to the high-pressure receiver 14, where partial condensation of water steam occurs. The condensate from the high-pressure receiver 14 is sent to the condensate normalization system 31. The compressor 13 also has an input for capturing atmospheric air to maintain a constant pressure in the receiver 14, since the vacuum pump 12 operates in intermittent mode and does not provide the necessary air volume to maintain the pressure in the high-pressure receiver 14. Condensate from the high-pressure receiver 14 is periodically removed and fed to the condensate normalization system 31. The steam-air mixture and volatile compounds from the high-pressure receiver 14 are supplied to the input 94 of the air-plasma steam generator 15 as a plasma-forming gas for the indirect arc plasma torch 75 of the air-plasma steam generator 15. The cleaned and disinfected steam-air mixture is fed from the output 103 of the air-plasma steam generator 15 to the first condenser 19, where water steam condenses, the cleaned and disinfected air is released into the atmosphere 21 and further condensate is fed into the condensate normalization system 31. Thus, the air-plasma steam generator 15 simultaneously performs three functions: the first function is plasma cleaning and air disinfection, the second function is to generate superheated steam for the plasma torches 75 of the fast plasma gasification reactor 16 operation, and the third function is to condense water steam and obtain significant volumes of technological water for the entire production process of the structural configuration of the invention. The layout of the plasma steam generator 15 is shown in FIG. 7. Dehydrated and dried solid waste and biomass from the vacuum and temperature drying system 3 are fed to the solid waste and biomass shredding system 4, where they are shredded to a fraction of 1-3 mm to ensure further possibility of maximum separation of metals and fast plasma gasification with minimum energy costs. From the output of the solid waste and biomass shredding system 3, the shredded waste and biomass are fed to the metal separation system 5, where the separation and accumulation of ferrous metals takes place, which are fed to the output of marketable products of ferrous metals 6 for supply to external consumers, as well as the separation and accumulation of non-ferrous metals that are supplied to the output of marketable products of non-ferrous metals 7 for supply to external consumers. From the output of the metal separation system 5, the shredded solid waste and biomass are fed to the shredded waste and biomass storage tank 8. From there the shredded solid waste and biomass feeding system 9 provides a periodic supply of shredded solid waste and biomass to the solid waste and biomass dosing system 10. An example of the implementation of this system is shown in FIG. 5 and FIG. 6. The shredded solid waste and biomass 67 are fed to the dosing system storage tank 71, to the shredded solid waste and biomass input 66, where they are compacted by the dosing system forcer 68, to reduce the amount of air in the dosing system storage tank 71 and, at the same time, the air is released into the atmosphere through the air valve 69. Through the carbon dioxide input 70 of the solid waste and biomass dosing system 10, a small dose of carbon dioxide is supplied to displace the remaining air from the shredded solid waste and biomass 67, thereby limiting the access of air when solid waste and biomass are fed in the dosing method into the fast plasma gasification reactor 16. The presence of carbon dioxide in the dosing system storage tank 71 provides fire protection against ignition during dosing of shredded solid waste and biomass. Further, this dose of carbon dioxide is completely utilized together with the shredded solid waste and biomass in the fast plasma gasification reactor 16. The dosing system doser 72 is of blade type (it can be of another type, depending on the location of the storage tank 71) and the dosing system output gate 73 provides continuous supply of shredded solid waste and biomass 67 to the plasma gasification zone of the fast plasma gasification reactor 16, protection from temperature effects of plasma infrared radiation and the penetration of superheated steam and pyrolysis gas into the storage tank 71.

In accordance with one of the embodiments of the structural configuration of the invention, the technological process for the fast plasma gasification and related technological processes, as well as equipment implementing the operation of these technological processes, operate as follows. Fast plasma gasification of the organic part of shredded solid waste and biomass is ensured by the passage of all particles of shredded solid waste and biomass through a layer of water-steam plasma with a temperature of 6000-15000° C., due to which their complete molecular destruction occurs, as well as the destruction of all gases $C_xH_y$ to $C+H_2$ and the conversion of free carbon by water steam in accordance with the formula $C+H_2O=CO+H_2$ in the complete absence of air access, which excludes the formation of furans, dioxins, nitrogen oxides and other environmentally hazardous compounds. The pyrolysis gas is mixed with superheated steam and thereby any unwanted chemical reactions due to the high dynamic viscosity of the superheated steam are safely prevented. The examples of the embodiments of fast plasma gasification reactors implementing the abovementioned process are shown in FIG. 5 and FIG. 6.

An example of one embodiment of a fast plasma gasification reactor 16 using indirect arc plasma torches 75 is shown in FIG. 5. The upper part of the fast plasma gasification reactor 16 is built on a cascade principle and consists of plasma gasification plasma torch modules 74. Each module consists of at least two indirect arc plasma torches 75 located at an angle relative to the vertical axis of the fast plasma gasification reactor 16, and forms one gasification cascade. Such arrangement makes it possible to increase the productivity of the fast plasma gasification reactor 16 by adding gasification cascades 74 without changing the design of the entire reactor unit. The indirect arc plasma torches 75 tilt ensures the excess pressure in the lower part of the fast plasma gasification reactor 16 and a reduced pressure zone under the dosing system output gate 73, which excludes the penetration of the steam-gas mixture into the dosing system output gate 73. Complete gasification of the organic part of the shredded solid waste and biomass is ensured by picking up all particles by the water steam plasma jet 76 of the first indirect arc plasma torch 75 of the upper plasma gasification cascade 74 and feeding them into the hottest zone of water steam plasma output of the subsequent indirect arc plasma torch 75. Thus, the trajectory of the shredded solid waste and biomass particles becomes zigzag and the time of their passage through the plasma gasification zone increases, which ensures their complete thermal destruction and fast plasma gasification. The inorganic components of the shredded solid waste and biomass enter the lower part of the fast plasma gasification reactor 16, where they are melted, and the slag melt 81 is accumulated in the slag bath 77. Slag bath 77 is made of a lining and its design provides melting of inorganic particles on the surface of the working table of the slag bath, the slag melt flowing off and accumulation in the perimeter zone of the slag bath 77. Thus, the complete melting of the shredded solid waste and biomass inorganic components is ensured, their falling onto the surface of the slag melt is excluded, as well as their coking, capsulating, splashing of the slag melt and contamination of the inner lining of the plasma reactor and its other components.

The slag melt is discharged through the overflow lip of the molten slag draining system 82. The slag heating plasma torch 78 provides continuous heating of the molten slag draining system 82, and also allows to regulate the slag drainage by changing the pressure of the plasma torch 79 on the surface of the slag melt, thus providing both the adjustment of the slag level in the slag bath 77 and the frequency of slag drainage. Thus the obtained chemically resistant slag melt suitable for use as a building material (according to the IAEA ISO 6961-82 procedure, the rate of leaching of Na+ ions was $(2-3)*10^{-6}$ g/cm$^2$ and the rate of leaching of heavy metals was about $10^{-7}$ g/cm$^2$), which is fed through the molten slag draining system 82 into the slag collecting and granulating system 17, where it is collected and granulated slag is produced, which at the output 18, is supplied as a marketable product to external consumers.

The steam-gas mixture output 80 is located below the plasma gasification plasma torch modules 74, and thus the contact of the steam-gas mixture with particles of solid waste and biomass is excluded, as well as its contamination.

All plasma torches 75 and 78 of the fast plasma gasification reactor 16 through the cooling inputs 84 and cooling outputs 85 are united by a single cooling system of the heat recovery cooling unit 58, the heat from which is recovered during the drying of solid waste and biomass in the vacuum and temperature drying system 3. All indirect arc plasma torches 75 and 78 operate according to the scheme with "hot" cathode and anode manufactured from binary carbide compounds tungsten-tantalum or niobium-hafnium. Their cooling is carried out mainly due to the plasma-forming gas in the form of superheated steam supplied to the plasma torches inputs 88. Due to the use of binary carbide compounds in the manufacture of cathodes and anodes of the plasma torches, significant advantages are obtained, namely, an increase in the operating temperature of cathodes and anodes, an increase in the current density in the plasma-forming gas, a significant increase in the efficiency of plasma torches and their durability, and the elimination of the formation and dropout of condensate on the plasma torches' live parts, as well as an easy start-up on water steam without the need to add air or other gases as plasma-forming ones.

An example of another embodiment of the fast plasma gasification reactor using inductively coupled plasma is shown in FIG. 6. Structurally and functionally, a fast plasma gasification reactor using inductively coupled plasma is similar to the above example of one of the embodiments of a fast plasma gasification reactor using indirect arc plasma torches. The difference lies in the method of forming a plasma jet for shredded solid waste and biomass gasification. At the same time, the principle of cascade configuration of the plasma gasification process is preserved, as well as the identity of the plasma gasification induction modules 86 to increase the productivity of the fast plasma gasification reactor 16. The plasma gasification induction module 86 consists of a 27-54 MHz high-frequency generator 89 feeding the inducer 90, which is integrated into the module lining or wound over it. The inducer 90 is made of a copper water-cooled pipe and through the cooling inputs 84 and the cooling outputs 85 is connected to a single cooling system of the heat recovery cooling unit 58, the heat from which is recovered when drying solid waste and biomass in the vacuum and temperature drying system 3. All plasma gasification induction modules 86 are equipped with a high-frequency electromagnetic radiation protection shield 92. Plasma-forming gas, or a superheated steam, is supplied to input 88, which is structurally made in the form of one or more injectors to provide a symmetrical shape of the plasma jet of the inductively coupled plasma. The tilting of injectors about the vertical axis of the fast plasma gasification reactor 16 provides the stretching of the inductively coupled plasma jet 91 downward, beyond the inducer 90 limits and creates a reduced pressure zone under the dosing system output gate 73, thereby excluding any penetration of the steam-gas mixture into the dosing system output gate 73. The plasma initialization electrode 87 is used to initialize the plasma jet in the upper plasma gasification induction module 86 at the initial start-up. Plasma initialization is carried out by extending the hard-alloy plasma initialization electrode insert 87 into the inside the inducer 90, then heating it up in the high-frequency electromagnetic field of the inducer 90 and forming a plasma layer of superheated steam around it. When extracting the hard-alloy plasma initialization electrode insert 87, the plasma torch is maintained due to the high-frequency electromagnetic field inside the inducer 90 and the supply of superheated steam. The complete gasification of organic components of shredded solid waste and biomass is provided due to their deceleration by an electromagnetic field and steam plasma ions in an inductively coupled plasma jet 91.

In accordance with one of the embodiments of the structural configuration of the invention, the technological process of condensation, water treatment and gas conversion, and related technological processes, as well as equipment implementing the operation of these technological processes, operate as follows. From the steam-gas mixture output 80 of the fast plasma gasification reactor 16, the steam-gas mixture is fed to the input of the second condenser 20, where it is cooled, and water steam condenses in the form of an acidic condensate. Thus, the drying and cleaning of pyrolysis gas from water-soluble acidic components of pyrolysis gas, such as HCl and others, depending on the morphological composition of shredded solid waste and biomass, as well as recovery and return of process water for reuse, is carried out. From the second output of the second condenser 20, the acidic condensate is fed to the third input of the condensate normalization system 31, where condensates are accumulated and acidically Ph-normalized using a dosed supply of potassium hydroxide KOH from the alkali doser 32 connected to the sixth input of the condensate normalization system 31. As a result of the neutralization reaction, an aqueous solution of potassium salts is formed. From the condensate normalization system output 31, the water-salt solution is fed to the potassium salts solution and cleaned water membrane separation system input 33, where the water-salt solution is separated into pure water and an aqueous concentrated solution of potassium salts using reverse-osmosis membranes. The cleaned water is supplied to the cleaned water storage tank 34, and an aqueous concentrated potassium salts solution is fed through the potassium salts solution feeding system 36 into the potassium salts solution storage tank 37 and from it, through the potassium salts solution output 38, is supplied as potassium fertilizers—a marketable product—to external consumers.

Pyrolysis gas, from the first output of the second condenser 20, is fed to the first variable volume gasholder 22, where the pyrolysis gas begins to accumulate with a slight excess pressure, slightly above atmospheric. At the same time, the pyrolysis gas from the first output of the first variable volume gasholder 22 is supplied to the first input of the first recirculation Sabatier reactor 26. The recirculation Sabatier reactors 26 and 27 are completely identical and consist of chambers filled with a catalyst (catalytic loading) $NiAl_2O_3$ providing separation of gas streams, which are equipped with electric heaters to provide initial heating to a temperature of 300-350° C. and create conditions for the start of gas conversion chemical reactions according to the formulas:

$$CO_2+4H_2=CH_4+2H_2O \text{ and } CO+3H_2=CH_4+H_2O$$

The simultaneous and equilibrium behavior of the pyrolysis gas hydrogenation and methanation reactions is ensured by a variable-speed recirculating gas pump pumping the pyrolysis gas through the catalyst (catalytic loading). Since both reactions are weakly exothermic, further automatic maintenance of the catalyst temperature is carried out by varying the rate of pumping the gas mixture through the catalyst and switching off the forced heating of the catalyst. Thus, the maintenance of the recirculating autothermal Sabatier reaction is carried out. To ensure the complete conversion of CO and $CO_2$ into methane and water, an electrolyzer 39 is introduced into the technological process, from the second output of which hydrogen is supplied to the second inputs of the recirculation Sabatier reactors 26 and 27, depending on which of them is active, at the moment of the technological cycle. This is necessary both to maintain the superstoichiometric value of hydrogen for the complete conversion of the pyrolysis gas to methane and water, and to ensure periodic recovery of the catalyst (catalytic loading) in an environment of pure hydrogen at temperatures of 500-600° C. Oxygen obtained from electrolyzer 39 as a result of water electrolysis is accumulated in the third variable volume gasholder 40 and through the compression system 41 is supplied to the second constant volume gasholder 42, and then, through the oxygen output 43, oxygen, as a marketable product, is supplied to external consumers. From the output of the first recirculation Sabatier reactor 26, the steam-gas mixture is fed to the third condenser 24, where the steam-gas mixture is cooled, and water steam is condensed. The obtained condensate is fed to the condensate normalization system 31. Condensers 24 and 25 are connected to a single cooling system of the heat recovery cooling unit 58. The gas mixture, consisting of pyrolysis gas and methane obtained during the Sabatier reaction, is returned from the first output of the condenser 24 to the first variable volume gasholder 22, where the gas mixture is mixed with the accumulated pyrolysis gas coming from the fast plasma gasification reactor 16 and then again from the first variable volume gasholder 22 is fed to the input of the first recirculation Sabatier reactor 26 and the cycle is repeated. Thus, the first variable volume gasholder 22 is a buffer and storage tank at the same time. In the process of pyrolysis gas accumulation in a variable volume gasholder, it is quickly filled with pyrolysis gas, which has a volume several times larger than methane and, at the same time, a gas mixture consisting of a mixture of pyrolysis gas and methane is taken from a variable volume gasholder, and conversion of the pyrolysis gas into methane and its return to a variable volume gasholder takes place. With this technological solution, the completely independent operation of both the fast plasma gasification reactor 16 and the recirculation Sabatier reactor 26 are realized. When the first variable volume gasholder is completely filled with the gas mixture, the output of the pyrolysis gas coming from the fast plasma gasification reactor 16 is switched to the second variable volume gasholder 23, where it is filled with pyrolysis gas and the second recirculation Sabatier reactor 27 which operates with the second variable volume gasholder 23 is put into operation.

At the same time, the operation of the recirculation Sabatier reactor 26 continues until the conversion of pyrolysis gas to methane in the first variable volume gasholder 22 is complete. At low concentrations of pyrolysis gas in the gas mixture of the first variable volume gasholder 22, maintaining the recirculating autothermal Sabatier reaction becomes impossible and at this moment the electric heater of the catalytic loading of the first recirculating Sabatier reactor 26 is switched on, which maintains the optimum temperature of the catalytic loading until the process of complete conversion of the gas mixture into methane is completed. The end of the conversion process is evidenced by both the readings of the gas analyzer and the termination of condensation of water steam in the third condenser 24. At the end of the gas conversion cycle, methane from the first variable volume gasholder 22 through the compression system 28 is supplied under high pressure to the first constant volume gasholder 29. The operation of the second variable volume gasholder 23, the second recirculation Sabatier reactor 27 and the fourth condenser 25 are similar to the above-described process. The alternate filling of variable volume gasholders with pyrolysis gas and a continuous cycle of the recirculating autothermal Sabatier reaction in both variable volume gasholders ensures the continuity of the entire technological process. At the end of the gas conversion cycle in the second variable volume gasholder 23, methane through the compression system 28 is supplied under high pressure to the first constant volume gasholder 29, and then the cycle is repeated.

The accumulated methane in the first constant volume gasholder 29 is used as follows: part of the methane accumulated in the first constant volume gasholder 29 is used as a marketable product and through the methane output 30 is supplied to external consumers, and the other part of the methane accumulated in the first constant volume gasholder 29 is used for electric power and heat generation. For this purpose, methane from the first constant volume gasholder 29 is supplied as fuel gas to the electric power and heat generation system 44 of the electric power and heat generation unit 63. The electric power and heat generating system 44 can be made either in the form of a gas engine electric power station operating in cogeneration mode or in the form of a gas turbine electric power station operating in a cogeneration mode or in a combined cycle. During operation of the electric power and heat generating system 44, the exhaust gases generated during the operation of either a gas engine electric power station or a gas turbine electric power station are cooled in an exhaust gas cooling system 47 and supplied to the carbon dioxide capture system 51 of the carbon dioxide capture unit 64. As one of the embodiments of the carbon dioxide capture system 51, the carbon dioxide absorption and desorption method can be applied to the carbon dioxide capture system 51. Exhaust gases, after carbon dioxide removed, are directed to the exhaust stack 48 of the electric power and heat generation unit 63 and are emitted into the atmosphere in the form of environmentally friendly emission of gases, while environmental control of emissions is carried out by the environmental emission control system 56 of the process control and monitoring unit 65. The standby generator 50 of the electric power and heat generation unit 63 provides the initial start-up of all equipment of the structural configuration of the invention, as well as its operation during the preventive maintenance of the electric power and heat generating system 44 to meet own needs for electric power of the structural configuration. Carbon dioxide recuperated from the exhaust gases, the carbon dioxide capture system 51, is compressed in the third compression system 53 and accumulated in the third constant volume gasholder 53 and then sent to the second input of the solid waste and biomass dosing system 10 to restrict air access when solid waste and biomass are fed in the dosing method into the fast plasma gasification reactor 16, to ensure the fast plasma gasification. By the carbon dioxide backup cylinder battery 54 of the carbon dioxide capture unit 64 is provided carbon dioxide supply to the solid waste and biomass dosing system 10 at the initial start-up of the structural configuration of the invention, as well as its operation during preventive maintenance of the carbon dioxide capture unit 64. The generated electric power in the electric power and heat generation unit 63 is supplied to external customers through the first connection output 45, and the generated heat is supplied to external consumers through the second connection output 46. The process control and monitoring system 55 of the process control and monitoring unit 65, having two-way communication with all other units, provides multilevel control and management of the invention's structural configuration technological production process.

FIG. 2 shows another preferred embodiment of the structural configuration of the invention in the absence of the need for electric power and heat generation, which has the following difference from the structural configuration of the invention shown in FIG. 1:

In the absence of the need to generate electric power and heat to supply them to external consumers, a part of methane accumulated in the first constant volume gasholder 29 is used to generate electric power for own needs in an own-use electric power generation system 50, and the other part of methane accumulated in the first constant volume gasholder 29 is used as marketable products which is supplied to external customers through the methane output 30. The own-use electric power generation system 50 can be made either in the form of a gas engine electric power station or in the form of a gas turbine electric power station operating in a simple cycle. During operation of the electric power and heat generation system 50, the exhaust gases generated during the operation of either a gas engine electric power station or a gas turbine electric power station are cooled in an exhaust gas cooling system 47. Further, the electric power and heat generation unit 63 operates in a similar way, when instead of an own-use electric power generation system 50, an electric power and heat generation system 44 is installed.

The solution according to the invention ensures achievement of the following stated objectives and technological advantages:

- the efficiency of electric and thermal power generation is increased during the processing of solid household and industrial waste and biomass and due to the use of methane as a fuel gas with a constant calorific value for the operation of the electric power and heat generation unit;
- the emission of carbon dioxide into the atmosphere during the production of electric power and heat is reduced by means of capturing carbon dioxide from the exhaust gases of the electric power and heat generation unit and supplying it to the solid waste and biomass dosing system of the solid waste and biomass preparation unit;
- the efficiency of processing solid household and industrial waste and biomass of a plasma reactor increases without increasing its physical volume, due to the use of an expandable cascade configuration of plasma gasification plasma torch modules or plasma gasification induction modules;

the environmental safety of processing solid waste and biomass is increased by ensuring the passage of all particles of shredded solid waste and biomass through a layer of water-steam plasma with a temperature of 6000-15000° C., which excludes the formation of furans, dioxins, nitrogen oxides and others environmentally hazardous compounds;

the production of environmentally friendly chemically resistant basalt-like slag, suitable for use as a building material, with the following characteristics: the rate of leaching of Na+ ions $(2-3)*10^{-6}$ g/cm$^2$ and the rate of leaching of heavy metals about $10^{-7}$ g/cm$^2$;

the nomenclature of manufactured marketable products obtained in the processing of solid household and industrial waste and biomass is expanding, namely it is now possible to produce methane, oxygen, cleaned water, potassium salts solution as potassium fertilizers;

the range of processed waste is expanding with the possibility of processing waste at a humidity of up to 80% by introducing a vacuum and temperature drying system into the solid waste and biomass preparation unit;

due to the use of binary carbide compounds of tungsten-tantalum or niobium-hafnium in the manufacture of cathodes and anodes of indirect arc plasma torches, the following significant technical advantages are obtained:

increasing the operating temperature of the cathodes and anodes of plasma torches, increasing the current density in the plasma-forming gas, significant increase in the efficiency of plasma torches, increasing the service life of plasma torches, preventing formation and dropout of condensate on the current-carrying parts of the plasma torches, providing easy initial steam-driven start-up without any need to add air or other gases as plasma gases.

The economic advantages of the invention are as follows:

The economic efficiency increases and the payback period of the Complexes implementing the method of environmentally safe processing of solid waste and biomass using fast plasma gasification and pyrolysis gas conversion is reduced by eliminating the significant capital costs required to equip the Complexes with pyrolysis gas purification systems and suppression of toxic substances such as furans and dioxins, which implement other technologies for processing solid waste and biomass.

Complexes that implement the method of environmentally safe processing of solid waste and biomass using fast plasma gasification and pyrolysis gas conversion do not require connection to external communications, since they provide own electric power and water, which allows for their cost-effective construction in remote regions, as well as creation of mobile versions of installations, and also opens up the possibility of placing a mobile option on floating platforms and ships, for cleaning the world's oceans from floating islands of waste Expected Areas of Application of the Invention:

The invention relates to the fields of energy, ecology, to the field of thermal processing of waste and biomass using their energy potential to generate electrical and thermal energy, to the agricultural and construction fields, as well as to the field of oxygen and methane production as marketable products for various industries.

The invention claimed is:

1. A structural configuration for environmentally safe solid waste and biomass processing to increase the efficiency of power generation and production of other useful products, which comprises a solid waste and biomass preparation unit (57), comprising a solid waste and biomass loading and crushing system (2), a solid waste and biomass shredding system (4), a metal separator system (5), a shredded solid waste and biomass storage tank (8) and a shredded solid waste and biomass feeding system (9); a solid waste and biomass loading and crushing system input (2) is also the solid waste and biomass treatment input (1) of the solid waste and biomass preparation unit (57); the output of the solid waste and biomass shredding system (4) is connected to the metal separator system input (5), the first output of the metal separator system (5) is connected to the input of the shredded solid waste and biomass storage tank (8), the second output of the metal separator system (5) is the output of marketable ferrous metals, and is also the first output of the solid waste and biomass preparation unit (57), the third output of the metal separator system (5) is the output of marketable non-ferrous metals, and is also the first output of the solid waste and biomass preparation unit (57); the first output of the solid waste and biomass preparation unit (57) is also the output of the marketable ferrous metals products of the configuration (6), the second output of the solid waste and biomass preparation unit (57) is also the output of the marketable non-ferrous metals products of the configuration (7); the output of the shredded solid waste and biomass storage tank (8) is connected to the input of the shredded solid waste and biomass feeding system (9); it comprises also a fast plasma gasification unit (59), comprising a slag collecting and granulating system (17), the output of the slag collecting and granulating system (17) is the output of the marketable granular slag products, and is also the first output of the fast plasma gasification unit (59), the first output of the fast plasma gasification unit (59) is also the output of marketable granular slag products of the configuration (18); an electric power and heat generation unit (63) comprises at least one electric power and heat generation system (44) or an own-use electric power generation system (50), also at least one exhaust gases cooling system (47), at least one exhaust stack (48) and a standby generator (49), where the first output of at least one electric power and heat generation system (44) is also the first output of the electric power and heat generation unit (63), the first output of which is also the first connection output for external consumers of the configuration (45), the second output of at least one electric power and heat generation system (44) is also the second output for the electric power and heat generation unit (63), the second output of at least one electric power and heat generation unit (63) is also a second connection output for connection of the external heat consumers of the configuration (46), the third output of at least one electric power and heat generation system (44) is connected to at least one exhaust gas cooling system (47), the output of at least one exhaust gas cooling system (47) is also the third output of the electric power and heat generation unit (63), the first input of the electric power and heat generation unit (63) is the first the input of at least one electric power and heat generation system (44); the a carbon dioxide capture unit (64) comprises a carbon dioxide capture system (51), a third compression system (52), a third constant volume gasholder (53) and a carbon dioxide backup cylinder battery (54), where the third output of the electric power and heat generation unit (63) is connected to the input of the carbon dioxide capture unit (64), the input of which is also the first input of the carbon dioxide capture system (51), the output of the carbon dioxide capture system (51) through the third compression system (52) is connected to the input of the third constant volume gasholder (53), the output of which is combined with the output of the carbon dioxide backup cylinder battery (54) and is also the first output of the carbon dioxide capture unit (64), the second output of the carbon dioxide capture system (51), which is also the second output of the carbon dioxide capture unit (64), to which the input of at least one exhaust stack (48) of the electric power and heat generation unit (63) is connected, the input of at least one exhaust stack (48) is also the second input of the electric power and heat generation unit (63), and the output of at least one exhaust stack (48) is also the fourth output of the electric power and heat generation unit (63), where the output of at least one exhaust stack (48) is connected to the input of the process control and monitoring unit (65) comprising a process control and monitoring system (55) and at least one environmental emission control system (56) and having two-way connections with other units of the configuration, the input of at least one environmental emission control system (56) is also the input of the process control and monitoring unit (65); in the absence of the need to generate electric power and heat, instead of an electric power and heat generation system (44), an electric power and heat generation unit (63) comprises own-use electric power generation system (50), the input of the own-use electric power generation system (50) is also the first input of the electric power and heat generation unit (63), and the output of the own-use electric power generation system (50) is connected to the input of at least one exhaust gas cooling system (47), the structural configuration further comprises a heat recovery cooling unit (58), a gas conversion unit (60), a condensate processing unit (61) and a hydrogen-oxygen unit (62), where the solid waste and biomass preparation unit (57) additionally comprises a vacuum and temperature drying system (3), a solid waste and biomass dosing system (10) and a vacuum pump (12), the output of the shredded solid waste and biomass feeding system (9) is connected to the first input of the solid waste and biomass dosing system (10), the first output of which is also the fourth output of the solid waste and biomass preparation unit (57), which is connected to the first input of the fast plasma gasification unit (59);

the fast plasma gasification unit (59) additionally comprises a compressor (13), a high-pressure receiver (14), an air-plasma steam generator (15), a fast plasma gasification reactor (16), the first condenser (19) and the second condenser (20), the first input of the fast plasma gasification unit (59) is also the second input of the fast plasma gasification reactor (16); the output of the solid waste and biomass loading and crushing system (2) is connected to the first input of the vacuum and temperature drying system (3), the first output of which is connected to the input of the solid waste and biomass shredding system (4), and the second output of the vacuum and temperature drying system (3) is connected to the input of the vacuum pump (12), the second input of the vacuum drying and temperature drying system (3) is connected to the second output of the solid waste and biomass dosing system (10), the third input of which is also the first input of the solid waste and biomass preparation unit (57), the second input of the solid waste and biomass dosing system (10) is also the second input of the solid waste and biomass preparation unit (57) and is connected to the first output of the carbon dioxide capture unit (64), the third output of the solid waste and biomass dosing system (10) is also the sixth output of the solid waste and biomass preparation unit (57), the fifth output of which is also the third output of the vacuum and temperature drying system (3), the sixth output of the solid waste and biomass preparation unit (57) is also the output of the air release (11) into the atmosphere of the configuration, the output of the vacuum pump (12) is also the third output of the solid waste and biomass preparation unit (57) and is connected to the second input of the fast plasma gasification unit (59); the second input of the fast plasma gasification unit (59) is also the input of the compressor (13), the output of which is connected to the input of the high-pressure receiver (14), the first output of the high-pressure receiver (14) is connected to the first input of the air plasma steam generator (15), the first output of which is connected to the first the input of the fast plasma gasification reactor (16), the second output of the air plasma steam generator (15) is connected to the first input of the first condenser (19), the third output of which is also the seventh output of the fast plasma gasification unit (59), the seventh output of the fast plasma gasification unit (59) is also the output for the cleaned and disinfected air release (21) into the atmosphere of the configuration, the second output of the first condenser (19) is connected to the third input of the air-plasma steam generator (15), the third output of which is also the sixth output of the fast plasma gasification unit (59), the first output of the fast plasma gasification reactor (16) is connected to the first input of the second condenser (20), the third output of which is connected to the second input of the first condenser (19), the third output of the fast plasma gasification reactor (16) is connected to the second input of the second condenser (20), the first output of which is also the second output of the fast plasma gasification unit (59), the input of the slag collection and granulating system (17) is connected to the second output of the fast plasma gasification reactor (16), the third input of which is also the fourth input of the fast plasma gasification unit (59), the second output of the high pressure receiver 14 is also the third output of the fast plasma gasification unit (59), the fourth output of which is also the first output of the first condenser (19), the second output of the second condenser (20) is also the fifth output of the fast plasma gasification unit (59), the third input of which is also the second input of the air-plasma steam generator (15).

2. The structural configuration as set forth in claim 1, wherein the gas conversion unit (60) comprises the first variable volume gasholder (22), the second variable volume gasholder (23), the third condenser (24), the fourth condenser (25), the first recirculation Sabatier reactor (26), the second recirculation Sabatier reactor (27), the first compression system (28) and the first constant volume gasholder (29), the first input of the first variable volume gasholder (22) is also the first input of the gas conversion unit (60), the second input of which is also the first input of the second variable volume gasholder (23), the first and second inputs of the gas conversion unit (60) are connected to the second output of the fast plasma gasification unit (59), the first output of the first variable volume gasholder (22) is connected to the first input of the first recirculation Sabatier reactor (26), the output of which is connected to the first input of the third condenser (24), the first output of which is connected to the second input of the first variable volume gasholder (22), the first output of the second variable volume gasholder (23) is connected to the first input of the second recirculation Sabatier reactor (27), the output of which is connected to the first input of the fourth condenser (25), the first output of which is connected to the second input of the second variable volume gasholder (23), the fifth input of the gas conversion unit (60) is also the second input of the fourth condenser (25), the third output of which is connected to the second input of the third condenser (24), the third output of which is also the fifth output of the gas conversion unit (60), the second output of the third condenser (24) is also the third output of the gas conversion unit (60), the fourth output of which is also the second output of the second condenser (25), the second input of the first recirculation Sabatier reactor (26) is also the third input of the gas conversion unit (60), the fourth input of which is also the second input of the second recirculation Sabatier reactor (27), the second output of the first variable volume gasholder (22) and the second output of the second variable volume gasholder (23) are combined and, through the first compression system (28), are connected to the input of the first constant volume gasholder (29), the first input of the power and heat generation unit (63) is connected to the first output of the gas conversion unit (60), the first output of which is also the first output of the first constant volume gasholder (29), the second output of the first constant volume gasholder (29) is also the second output of the gas conversion unit (60), the second output of which is also the output of the marketable methane product (30) of the configuration.

3. The structural configuration as set forth in claim 1, wherein the condensate processing unit (61) comprises a condensate normalization system (31), an alkali dispenser (32), a potassium salts solution and purified water membrane separation system (33), a purified water storage tank (34), potassium salts solution feeding system (36) and potassium salts solution storage tank (37), the third output of the fast plasma gasification unit (59) is connected to the first input of the condensate processing unit (61), the first input of which is also the first input of the condensate normalization system (31), the fourth output of the fast plasma gasification unit (59) is connected to the second input of the condensate processing unit (61), the second input of which is also the second input of the condensate normalization system (31), the fifth output of the fast plasma gasification unit (59) is connected to the third input of the condensate processing unit (61), the third input of which is also the third input of the condensate normalization system (31), the third output of the gas conversion unit (60) is connected to the fourth input of the condensate processing unit (61), the fourth input of which is also the fourth input of the condensate normalization system (31), the fourth output of the gas conversion unit (60) is connected to the fifth input of the condensate processing unit (61), the fifth the input of which is also the fifth input of the condensate normalization system (31), the output of the alkali dispenser (32) is connected to the sixth input of the condensate normalization system (31), the output of which is connected to the input of the potassium salts solution and purified water membrane separation system (33), the first output the potassium salts solution and purified water membrane separation system (33) is connected to the input of the purified water storage tank (34), the second output of the potassium salts solution and purified water membrane separation system (33) through potassium salts solution feeding system (36) is connected to the input of the potassium salts storage tank (37), the output of the potassium salts storage tank (37) is also the first output of the condensate processing unit (61), the first output of which is also the output of the marketable potassium salts solution product (38) of the configuration, the third input of the fast plasma gasification unit (59) is connected to the second output of the condensate processing unit (61), the second output of which is also the first output of the purified water storage tank (34), the second output of the purified water storage tank (34) is also the third output of the condensate processing unit (61), the third output of which is also the output of the marketable purified water product (35) of the configuration, the third output of the purified water storage tank (34) is also the fourth output of the condensate processing unit (61).

4. The structural configuration as set forth in claim 1, wherein the hydrogen-oxygen unit (62) comprises an electrolyzer (39), the third variable volume gasholder (40), the second compression system (41) and the second constant volume gasholder (42), the fourth output of the condensate processing unit (61) is connected to the first input of the hydrogen-oxygen unit (62), the first input of which is also the input of the electrolyzer (39), the first output of the electrolyzer (39) through the third variable volume gasholder (40) and the second compression system (41) is connected to the input of the second constant volume gasholder (42), the output of the second constant volume gasholder (42) is also the first output of the hydrogen-oxygen unit (62), the first output of which is also the output of marketable oxygen product (43) of the configuration, the third and the fourth inputs of the gas conversion unit (60) are connected to the second output of the hydrogen-oxygen unit (62), the second output of which is also the second output of the electrolyzer (39).

5. The structural configuration as set forth in claim 1, wherein the input of the heat recovery cooling unit (58) is connected to the sixth output of the fast plasma gasification unit (59), the output of the heat recovery cooling unit (58) is connected to the first input of the solid waste and biomass preparation unit (57), the fifth output of which is connected to the fifth input of the gas conversion unit (60), the fifth output of which is connected to the fourth input of the fast plasma gasification unit (59).

6. The structural configuration as set forth in claim 1, wherein the solid waste and biomass dosing system (10) comprises a shredded solid waste and biomass loading input (66), a dosing system forcer (68), an air valve (69), a carbon dioxide input (70), a dosing system storage tank (71), a dosing system doser (72), a dosing system output gate (73), a cooling input (84) and a cooling output (85), in the upper part of the dosing system storage tank (71), a dosing system forcer (68) with an air valve (69) is installed, and at the bottom of the output of the dosing system storage tank (71), a dosing system doser (72) is installed, the synchronous feeding of shredded solid waste and biomass for fast plasma gasification in the fast plasma gasification reactor (16) is ensured by the output gate of the dosing system (73) installed at the bottom of the dosing system storage tank (71), downstream the dosing system doser (72), cooling of the dosing system doser (72) and the output gate of the dosing system (73) are provided by supplying water from the heat recovery cooling unit (58) through the cooling inputs (84) and cooling outputs (85).

7. The structural configuration as set forth in claim 1, wherein the fast plasma gasification reactor (16) comprises at least one plasma gasification plasma torch module (74) containing at least two indirect arc plasma torches (75), a slag heating plasma torch (78), a steam-gas mixture output (80), a molten slag draining system (82), an emergency slag draining plug (83), a cooling input (84) and a cooling output (85), at least one plasma gasification plasma torch module (74) is installed in the middle part of the fast plasma gasification reactor (16), which can be cascade in-built into the fast plasma gasification reactor housing (16), in the lower part of the fast plasma gasification reactor there is a slag bath (77) comprising at least two indirect arc plasma torches (75), a molten slag draining system (82) is installed on the side of the slag bath (77), which comprises a slag heating plasma torch (78), for an emergency slag draining, in the lower part of the slag bath (77) there is an emergency slag draining plug (83), cooling of at least two indirect arc plasma torches (75) installed in at least one of plasma gasification plasma torch module (74), at least two indirect arc plasma torches (75) installed in the slag bath (77) and the slag heating plasma torch (78) are provided by supplying water from the heat recovery cooling unit (58) through the cooling inputs (84) and cooling outputs (85); all indirect arc plasma torches (75) and (78) are made according to the scheme with a hot cathode and anode, which are made of binary carbide compounds of tungsten-tantalum or niobium-hafnium.

8. The structural configuration as set forth in claim 1, wherein the fast plasma gasification reactor (16) comprises at least one plasma gasification induction module (86) comprising at least one high-frequency generator 27-54 MHz (89) and at least one inducer (90), as well as the plasma initialization electrode (87) and at least one superheated steam input (88), in the middle part of the fast plasma gasification reactor (16) is installed at least one plasma gasification induction module (86), which can be cascade in-built into the fast plasma gasification reactor housing (16), the plasma initialization electrode (87) and at least one superheated steam input (88) are located in the upper part of the fast plasma gasification reactor (16), immediately upstream the upper at least one plasma gasification induction module (86); at least one 27-54 MHz high-frequency generator (89) is connected to at least one inducer (90), at least one inducer (90), is provided with at least one protection shield against high-frequency electromagnetic radiation (92), the cooling of the inducer (90) is provided by supplying water from the heat recovery cooling unit (58) through the cooling inputs (84) and cooling outputs (85).

9. The structural configuration as set forth in claim 1, wherein the air-plasma steam generator (15) comprises an indirect arc plasma torch (75), an air-plasma steam generator housing (93), a steam-air mixture and volatile compounds input (94), a superheated steam output (97), a purified water input (98), a water level sensor (100), an evaporator (101), an evaporator manifold (102) and a steam-air mixture output (103); inside the air-plasma steam generator housing (93) an evaporator (101) is installed, upstream of which an indirect arc plasma torch (75) is located; downstream, at the output of the evaporator (101), an evaporator manifold (102) is installed; a high-temperature zone (95) and a zone of superheated steam (96) are separated in the air-plasma steam generator housing (93), to control the level of purified water (99) coming from the purified water input (98), a water level sensor (100) is built into the air-plasma steam generator housing (93).

10. A method for environmentally safe solid waste and biomass processing to increase the efficiency of electric power generation and other useful products, during which solid waste and biomass are loaded, crushed and shredded, and ferrous and non-ferrous metals are separated from them and supplied as marketable products to external consumers, and cleaned from metals shredded solid waste and biomass are accumulated, then accumulated shredded solid waste and biomass separated from metals are fed in the dosing method into the fast plasma gasification reactor, in the fast plasma gasification reactor the shredded solid waste and biomass are subjected to fast plasma gasification, during which melting occurs and a basalt-like slag is formed, which is processed to obtain granulated slag, and the obtained granulated slag, as a marketable product, is supplied to external consumers; part of the accumulated methane in the first constant volume gasholder is used for electric power and heat generation, while part of the generated electric power is supplied for own use, and the other part of the generated electric power and heat is supplied to external consumers, carbon dioxide captured from the exhaust gases formed during the electric power and heat generation is compressed, accumulated; in the absence of the need to generate electric power and heat, electric power for own use is generated from part of the accumulated methane in the first constant volume gasholder, wherein solid waste and biomass are subjected to vacuum and temperature drying, in the process of vacuum and temperature drying, vacuum extraction of volatile compounds and water steam from solid waste and biomass is provided, the steam-air mixture and volatile compounds are compressed and accumulated, then the accumulated steam-air mixture and volatile compounds are subjected to plasma cleaning-disinfection and superheated steam is generated, which, as a plasma-forming gas, is fed to the indirect arc plasma torches to the fast plasma gasification reactor for fast plasma gasification, and the steam-air mixture obtained in the process of plasma cleaning-disinfection is condensed, separating water steam from the steam-air mixture extracted from solid waste and biomass, and purified and decontaminated air is released into the atmosphere.

11. The method as set forth in claim 10, wherein the accumulated dehydrated, dried and shredded solid waste and the biomass purified from metals are fed in the dosing method into the fast plasma gasification reactor, while ensuring the discharge of excess air formed during the dosing process into the atmosphere, in the fast plasma gasification reactor, shredded solid waste and biomass purified from metals are subjected to fast plasma gasification, while the obtained steam-gas mixture as a result of fast plasma gasification is condensed, separating water steam from the steam-gas mixture, the gas mixture freed from water steam, in the form of pyrolysis gas, is accumulated in turn in two variable volume gasholders.

12. The method as set forth in claim 10, wherein the hydrogen obtained as a result of electrolysis, as well as the pyrolysis gas from the first of the two variable volume gasholders are fed to the first of the two recirculation Sabatier reactors for carrying out a recirculating autothermal Sabatier reaction, the obtained steam-gas mixture as a result of the recirculating autothermal Sabatier reaction, containing mainly methane, is condensed, separating water steam from the steam-gas mixture, the obtained gas mixture is accumulated in the first of two variable volume gasholders, while the cycle consisting of feeding hydrogen obtained in as a result of electrolysis and of feeding pyrolysis gas from the first of the two variable volume gasholders to the first of the two recirculation Sabatier reactors to carry out the recirculating autothermal Sabatier reaction, is repeated until there is a complete conversion of the gas mixture located in the first of the two variable volume gasholders into methane and the entire first gasholder will not be filled with methane, while the methane content in the steam-gas mixture will increase with each successive cycle, and the total time of the gas mixture conversion cycles is limited and is determined by the ratio of the temperature parameters of the recirculation autothermal Sabatier reaction and parameters of the fast plasma gasification, after filling the first of the two variable volume gasholders with methane, methane obtained from the first of the two variable volume gasholders is compressed and accumulated in the first constant volume gasholder, at the same time, hydrogen obtained as a result of electrolysis, as well as pyrolysis gas from the second of the two variable volume gasholders are fed to the second of the two recirculation Sabatier reactors to carry out a recirculating autothermal Sabatier reaction, the steam-gas mixture obtained as a result of the recirculating autothermal Sabatier reaction, containing mainly methane, is condensed, separating the water steam from the steam-gas mixture, the obtained gas mixture is accumulated in the second of the two variable volume gasholders, wherein the cycle consisting of feeding hydrogen obtained as a result of electrolysis and of feeding pyrolysis gas from the second of the two variable volume gasholders to the second of the two recirculation Sabatier reactors to carry out the recirculating autothermal Sabatier reaction, is repeated until there is a complete conversion of the gas mixture located in the second of the two variable volume gasholders into methane and the entire second gasholder will not be filled with methane, wherein, the methane content in the steam-gas mixture will increase with each successive cycle, and the total time for the conversion cycles of the gas mixture into methane is limited and is determined by the ratio of the temperature parameters of the recirculating autothermal Sabatier reaction and the parameters of the fast plasma gasification, after filling the second of the two variable volume gasholders with methane, methane obtained from the second of the two variable volume gasholders is compressed and accumulated in the first constant volume gasholder, at the same time, the cycles of the pyrolysis gas and the gas mixture conversion into methane using a recirculating autothermal Sabatier reaction are repeated in the first recirculation Sabatier reactor and then repeated in the second recirculation Sabatier reactor, and thus, using the recirculating autothermal Sabatier reaction, the continuity of the technological process of converting pyrolysis gas to methane is ensured.

13. The method as set forth in claim 10, wherein the condensate obtained during condensation of water steam from a steam-gas mixture obtained during fast plasma gasification, condensate obtained during condensation of water steam from the steam-air mixture extracted from solid waste and biomass, condensate obtained during condensation of water steam from the steam-gas mixture obtained during the recirculating autothermal Sabatier reaction in the first recirculation Sabatier reactor, condensate obtained during the condensation of water steam from the steam-gas mixture obtained during the recirculating autothermal Sabatier reaction in the second recirculation Sabatier reactor, as well as the condensate formed during the accumulation of the steam-air mixture and volatile compounds are pH-normalized using alkali dosing, then the membrane separation of the obtained normalized condensate into a potassium salts solution and cleaned water is ensured, the obtained potassium salts solution is fed to the storage tank and accumulated, and then, as potassium fertilizers-marketable products-are supplied to external consumers, cleaned water is also accumulated, then part of the cleaned water is supplied for electrolysis, the other part of the cleaned water is supplied to ensure plasma cleaning-disinfection and generation of superheated steam, and the remaining third part, as a marketable product, is supplied to external consumers.

14. The method as set forth in claim 10, wherein the vacuum and temperature drying is provided due to the extraction of heat obtained during condensate cooling during condensation of water steam from the steam-gas mixture obtained during fast plasma gasification, from the steam-air mixture extracted from solid waste and biomass, from the steam-gas mixture obtained during the recirculating autothermal Sabatier reaction in the first recirculation Sabatier reactor, from the steam-gas mixture obtained during the recirculating autothermal Sabatier reaction in the second recirculation Sabatier reactor, as well as due to the extraction of heat generated in the process of plasma cleaning-disinfection of the steam-air mixture and volatile compounds, wherein, all these heat sources are combined into a single closed cooling loop with heat recovery for vacuum and temperature drying.

15. The method as set forth in claim 10, wherein oxygen obtained as a result of electrolysis is accumulated in the third variable volume gasholder, the accumulated oxygen is compressed and accumulated in the second constant volume gasholder, and then, as a marketable product, is supplied to external consumers; the accumulated methane in the first constant volume gasholder is used as follows: part of the methane accumulated in the first constant volume gasholder is used as a marketable product and supplied to external consumers, and the other part of the methane accumulated in the first constant volume gasholder is used to generate electric power and heat; the accumulated carbon dioxide captured from the exhaust gases formed during the electric power and heat generation or only during the electric power generation is directed to restrict the access of air when solid waste and biomass are fed in the dosing method to the fast plasma gasification reactor to ensure fast plasma gasification.

16. The method as set forth in claim 10, wherein in the absence of the need to generate electric power and heat, electric power for own use is produced from part of the methane accumulated in the first constant volume gasholder, and the other part of the methane accumulated in the first constant volume gasholder, is used as a marketable product and supplied to external consumers.

17. The method as set forth in claim 10, wherein in indirect arc plasma torches operating according to the scheme with hot cathode and anode, binary carbide compounds from tungsten as materials for the manufacture of anodes and cathodes-tantalum or niobium-hafnium are used.

* * * * *